US006495968B2

(12) United States Patent
Tokunaga

(10) Patent No.: US 6,495,968 B2
(45) Date of Patent: Dec. 17, 2002

(54) METHOD FOR DRIVING PLASMA DISPLAY PANEL

(75) Inventor: Tsutomu Tokunaga, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 1 day.

(21) Appl. No.: 09/891,220

(22) Filed: Jun. 26, 2001

(65) Prior Publication Data

US 2002/0014848 A1 Feb. 7, 2002

(30) Foreign Application Priority Data

Jul. 6, 2000 (JP) ..... 2000-205329

(51) Int. Cl.[7] ..... G09G 3/28
(52) U.S. Cl. ..... 315/169.4; 345/60; 345/63
(58) Field of Search ..... 315/169.1–169.4; 345/60, 63, 65, 67, 37

(56) References Cited

U.S. PATENT DOCUMENTS 5,818,419 A * 10/1998 Tajima et al. ..... 345/63

6,256,002 B1 * 7/2001 Shinoda ..... 345/60

* cited by examiner

*Primary Examiner*—David Vu
*Assistant Examiner*—Wilson Lee
(74) *Attorney, Agent, or Firm*—Sughrue Mion, PLLC

(57) ABSTRACT

The object is to provide a method for driving a plasma display panel, the method being capable of providing improved display quality. A display cell of the plasma display panel is reset to a light-emitting cell state (or a non-light-emitting cell state) only in the head subfield during the display period of one field. Then, in each subfield, executed is a data write process for applying successively a scanning pulse, for generating a selective erase discharge, to each of the row electrodes in order to change selectively each of the display cells from the light-emitting cell state (non-light-emitting cell state) to the non-light-emitting cell state (light-emitting cell state) in accordance with an input video signal. Also executed in each subfield is a light emission sustain process for applying a train of sustain pulses to each of the row electrodes in conjunction with the scanning pulse, the train of sustain pulses generating a sustain discharge to allow only a display cell in the light-emitting cell state to emit light for the number of times corresponding to a weight of each of the subfields.

4 Claims, 18 Drawing Sheets

FIG. 9

| LC | SF1 | SF2 | SF3 | SF4 | SF5 | SF6 | SF7 | SF8 | SF9 | SF10 | SF11 | SF12 | SF13 | SF14 |
|---|---|---|---|---|---|---|---|---|---|---|---|---|---|---|
| MODE 1 | 1 | 3 | 5 | 8 | 10 | 13 | 16 | 19 | 22 | 25 | 28 | 32 | 35 | 39 |
| MODE 2 | 2 | 6 | 10 | 16 | 20 | 26 | 32 | 38 | 44 | 50 | 56 | 64 | 70 | 78 |
| MODE 3 | 3 | 9 | 15 | 24 | 30 | 39 | 48 | 57 | 66 | 75 | 84 | 96 | 105 | 117 |
| MODE 4 | 4 | 12 | 20 | 32 | 40 | 52 | 64 | 76 | 88 | 100 | 112 | 128 | 140 | 156 |

FIG. 11

| PDBL | | PDP | | PDBL | | PDP | |
|---|---|---|---|---|---|---|---|
| BRIGHT-NESS | 1 ~ 8 | BRIGHT-NESS | 1 ~ 8 | BRIGHT-NESS | 1 ~ 8 | BRIGHT-NESS | 1 ~ 8 |
| 0 | 00000000 | 0 | 00000000 | 64 | 01000000 | 56 | 00111000 |
| 1 | 00000001 | 0 | 00000000 | 65 | 01000001 | 57 | 00111001 |
| 2 | 00000010 | 1 | 00000001 | 66 | 01000010 | 57 | 00111001 |
| 3 | 00000011 | 2 | 00000010 | 67 | 01000011 | 58 | 00111010 |
| 4 | 00000100 | 3 | 00000011 | 68 | 01000100 | 59 | 00111011 |
| 5 | 00000101 | 4 | 00000100 | 69 | 01000101 | 60 | 00111100 |
| 6 | 00000110 | 5 | 00000101 | 70 | 01000110 | 61 | 00111101 |
| 7 | 00000111 | 6 | 00000110 | 71 | 01000111 | 62 | 00111110 |
| 8 | 00001000 | 7 | 00000111 | 72 | 01001000 | 63 | 00111111 |
| 9 | 00001001 | 7 | 00000111 | 73 | 01001001 | 64 | 01000000 |
| 10 | 00001010 | 8 | 00001000 | 74 | 01001010 | 65 | 01000001 |
| 11 | 00001011 | 9 | 00001001 | 75 | 01001011 | 65 | 01000001 |
| 12 | 00001100 | 10 | 00001010 | 76 | 01001100 | 66 | 01000010 |
| 13 | 00001101 | 11 | 00001011 | 77 | 01001101 | 67 | 01000011 |
| 14 | 00001110 | 12 | 00001100 | 78 | 01001110 | 68 | 01000100 |
| 15 | 00001111 | 13 | 00001101 | 79 | 01001111 | 69 | 01000101 |
| 16 | 00010000 | 14 | 00001110 | 80 | 01010000 | 70 | 01000110 |
| 17 | 00010001 | 14 | 00001110 | 81 | 01010001 | 71 | 01000111 |
| 18 | 00010010 | 15 | 00001111 | 82 | 01010010 | 72 | 01001000 |
| 19 | 00010011 | 16 | 00010000 | 83 | 01010011 | 72 | 01001000 |
| 20 | 00010100 | 17 | 00010001 | 84 | 01010100 | 73 | 01001001 |
| 21 | 00010101 | 18 | 00010010 | 85 | 01010101 | 74 | 01001010 |
| 22 | 00010110 | 19 | 00010011 | 86 | 01010110 | 75 | 01001011 |
| 23 | 00010111 | 20 | 00010100 | 87 | 01010111 | 76 | 01001100 |
| 24 | 00011000 | 21 | 00010101 | 88 | 01011000 | 77 | 01001101 |
| 25 | 00011001 | 21 | 00010101 | 89 | 01011001 | 77 | 01001101 |
| 26 | 00011010 | 22 | 00010110 | 90 | 01011010 | 78 | 01001110 |
| 27 | 00011011 | 23 | 00010111 | 91 | 01011011 | 79 | 01001111 |
| 28 | 00011100 | 24 | 00011000 | 92 | 01011100 | 80 | 01010000 |
| 29 | 00011101 | 25 | 00011001 | 93 | 01011101 | 81 | 01010001 |
| 30 | 00011110 | 26 | 00011010 | 94 | 01011110 | 82 | 01010010 |
| 31 | 00011111 | 27 | 00011011 | 95 | 01011111 | 83 | 01010011 |
| 32 | 00100000 | 28 | 00011100 | 96 | 01100000 | 84 | 01010100 |
| 33 | 00100001 | 28 | 00011100 | 97 | 01100001 | 85 | 01010101 |
| 34 | 00100010 | 29 | 00011101 | 98 | 01100010 | 86 | 01010110 |
| 35 | 00100011 | 30 | 00011110 | 99 | 01100011 | 86 | 01010110 |
| 36 | 00100100 | 31 | 00011111 | 100 | 01100100 | 87 | 01010111 |
| 37 | 00100101 | 32 | 00100000 | 101 | 01100101 | 88 | 01011000 |
| 38 | 00100110 | 33 | 00100001 | 102 | 01100110 | 89 | 01011001 |
| 39 | 00100111 | 34 | 00100010 | 103 | 01100111 | 90 | 01011010 |
| 40 | 00101000 | 35 | 00100011 | 104 | 01101000 | 91 | 01011011 |
| 41 | 00101001 | 36 | 00100100 | 105 | 01101001 | 92 | 01011100 |
| 42 | 00101010 | 36 | 00100100 | 106 | 01101010 | 93 | 01011101 |
| 43 | 00101011 | 37 | 00100101 | 107 | 01101011 | 93 | 01011101 |
| 44 | 00101100 | 38 | 00100110 | 108 | 01101100 | 94 | 01011110 |
| 45 | 00101101 | 39 | 00100111 | 109 | 01101101 | 95 | 01011111 |
| 46 | 00101110 | 40 | 00101000 | 110 | 01101110 | 96 | 01100000 |
| 47 | 00101111 | 41 | 00101001 | 111 | 01101111 | 97 | 01100001 |
| 48 | 00110000 | 42 | 00101010 | 112 | 01110000 | 98 | 01100010 |
| 49 | 00110001 | 43 | 00101011 | 113 | 01110001 | 99 | 01100011 |
| 50 | 00110010 | 43 | 00101011 | 114 | 01110010 | 100 | 01100100 |
| 51 | 00110011 | 44 | 00101100 | 115 | 01110011 | 101 | 01100101 |
| 52 | 00110100 | 45 | 00101101 | 116 | 01110100 | 101 | 01100101 |
| 53 | 00110101 | 46 | 00101110 | 117 | 01110101 | 102 | 01100110 |
| 54 | 00110110 | 47 | 00101111 | 118 | 01110110 | 103 | 01100111 |
| 55 | 00110111 | 48 | 00110000 | 119 | 01110111 | 104 | 01101000 |
| 56 | 00111000 | 49 | 00110001 | 120 | 01111000 | 105 | 01101001 |
| 57 | 00111001 | 50 | 00110010 | 121 | 01111001 | 106 | 01101010 |
| 58 | 00111010 | 50 | 00110010 | 122 | 01111010 | 107 | 01101011 |
| 59 | 00111011 | 51 | 00110011 | 123 | 01111011 | 108 | 01101100 |
| 60 | 00111100 | 52 | 00110100 | 124 | 01111100 | 108 | 01101100 |
| 61 | 00111101 | 53 | 00110101 | 125 | 01111101 | 109 | 01101101 |
| 62 | 00111110 | 54 | 00110110 | 126 | 01111110 | 110 | 01101110 |
| 63 | 00111111 | 55 | 00110111 | 127 | 01111111 | 111 | 01101111 |

FIG. 12

| PDBL | | PDP | | PDBL | | PDP | |
|---|---|---|---|---|---|---|---|
| BRIGHT-NESS | 1 ~ 8 | BRIGHT-NESS | 1 ~ 8 | BRIGHT-NESS | 1 ~ 8 | BRIGHT-NESS | 1 ~ 8 |
| 128 | 10000000 | 112 | 01110000 | 192 | 11000000 | 168 | 10101000 |
| 129 | 10000001 | 113 | 01110001 | 193 | 11000001 | 169 | 10101001 |
| 130 | 10000010 | 114 | 01110010 | 194 | 11000010 | 170 | 10101010 |
| 131 | 10000011 | 115 | 01110011 | 195 | 11000011 | 171 | 10101011 |
| 132 | 10000100 | 115 | 01110011 | 196 | 11000100 | 172 | 10101100 |
| 133 | 10000101 | 116 | 01110100 | 197 | 11000101 | 173 | 10101101 |
| 134 | 10000110 | 117 | 01110101 | 198 | 11000110 | 173 | 10101101 |
| 135 | 10000111 | 118 | 01110110 | 199 | 11000111 | 174 | 10101110 |
| 136 | 10001000 | 119 | 01110111 | 200 | 11001000 | 175 | 10101111 |
| 137 | 10001001 | 120 | 01111000 | 201 | 11001001 | 176 | 10110000 |
| 138 | 10001010 | 121 | 01111001 | 202 | 11001010 | 177 | 10110001 |
| 139 | 10001011 | 122 | 01111010 | 203 | 11001011 | 178 | 10110010 |
| 140 | 10001100 | 122 | 01111010 | 204 | 11001100 | 179 | 10110011 |
| 141 | 10001101 | 123 | 01111011 | 205 | 11001101 | 180 | 10110100 |
| 142 | 10001110 | 124 | 01111100 | 206 | 11001110 | 180 | 10110100 |
| 143 | 10001111 | 125 | 01111101 | 207 | 11001111 | 181 | 10110101 |
| 144 | 10010000 | 126 | 01111110 | 208 | 11010000 | 182 | 10110110 |
| 145 | 10010001 | 127 | 01111111 | 209 | 11010001 | 183 | 10110111 |
| 146 | 10010010 | 128 | 10000000 | 210 | 11010010 | 184 | 10111000 |
| 147 | 10010011 | 129 | 10000001 | 211 | 11010011 | 185 | 10111001 |
| 148 | 10010100 | 130 | 10000010 | 212 | 11010100 | 186 | 10111010 |
| 149 | 10010101 | 130 | 10000010 | 213 | 11010101 | 187 | 10111011 |
| 150 | 10010110 | 131 | 10000011 | 214 | 11010110 | 187 | 10111011 |
| 151 | 10010111 | 132 | 10000100 | 215 | 11010111 | 188 | 10111100 |
| 152 | 10011000 | 133 | 10000101 | 216 | 11011000 | 189 | 10111101 |
| 153 | 10011001 | 134 | 10000110 | 217 | 11011001 | 190 | 10111110 |
| 154 | 10011010 | 135 | 10000111 | 218 | 11011010 | 191 | 10111111 |
| 155 | 10011011 | 136 | 10001000 | 219 | 11011011 | 192 | 11000000 |
| 156 | 10011100 | 137 | 10001001 | 220 | 11011100 | 193 | 11000001 |
| 157 | 10011101 | 137 | 10001001 | 221 | 11011101 | 194 | 11000010 |
| 158 | 10011110 | 138 | 10001010 | 222 | 11011110 | 195 | 11000011 |
| 159 | 10011111 | 139 | 10001011 | 223 | 11011111 | 195 | 11000011 |
| 160 | 10100000 | 140 | 10001100 | 224 | 11100000 | 196 | 11000100 |
| 161 | 10100001 | 141 | 10001101 | 225 | 11100001 | 197 | 11000101 |
| 162 | 10100010 | 142 | 10001110 | 226 | 11100010 | 198 | 11000110 |
| 163 | 10100011 | 143 | 10001111 | 227 | 11100011 | 199 | 11000111 |
| 164 | 10100100 | 144 | 10010000 | 228 | 11100100 | 200 | 11001000 |
| 165 | 10100101 | 144 | 10010000 | 229 | 11100101 | 201 | 11001001 |
| 166 | 10100110 | 145 | 10010001 | 230 | 11100110 | 202 | 11001010 |
| 167 | 10100111 | 146 | 10010010 | 231 | 11100111 | 202 | 11001010 |
| 168 | 10101000 | 147 | 10010011 | 232 | 11101000 | 203 | 11001011 |
| 169 | 10101001 | 148 | 10010100 | 233 | 11101001 | 204 | 11001100 |
| 170 | 10101010 | 149 | 10010101 | 234 | 11101010 | 205 | 11001101 |
| 171 | 10101011 | 150 | 10010110 | 235 | 11101011 | 206 | 11001110 |
| 172 | 10101100 | 151 | 10010111 | 236 | 11101100 | 207 | 11001111 |
| 173 | 10101101 | 151 | 10010111 | 237 | 11101101 | 208 | 11011000 |
| 174 | 10101110 | 152 | 10011000 | 238 | 11101110 | 209 | 11010001 |
| 175 | 10101111 | 153 | 10011001 | 239 | 11101111 | 209 | 11010001 |
| 176 | 10110000 | 154 | 10011010 | 240 | 11110000 | 210 | 11010010 |
| 177 | 10110001 | 155 | 10011011 | 241 | 11110001 | 211 | 11010011 |
| 178 | 10110010 | 156 | 10011100 | 242 | 11110010 | 212 | 11010100 |
| 179 | 10110011 | 157 | 10011101 | 243 | 11110011 | 213 | 11010101 |
| 180 | 10110100 | 158 | 10011110 | 244 | 11110100 | 214 | 11010110 |
| 181 | 10110101 | 158 | 10011110 | 245 | 11110101 | 215 | 11010111 |
| 182 | 10110110 | 159 | 10011111 | 246 | 11110110 | 216 | 11011000 |
| 183 | 10110111 | 160 | 10010000 | 247 | 11110111 | 216 | 11011000 |
| 184 | 10111000 | 161 | 10100001 | 248 | 11111000 | 217 | 11011001 |
| 185 | 10111001 | 162 | 10100010 | 249 | 11111001 | 218 | 11011010 |
| 186 | 10111010 | 163 | 10100011 | 250 | 11111010 | 219 | 11011011 |
| 187 | 10111011 | 164 | 10100100 | 251 | 11111011 | 220 | 11011100 |
| 188 | 10111100 | 165 | 10100101 | 252 | 11111100 | 221 | 11011101 |
| 189 | 10111101 | 166 | 10100110 | 253 | 11111101 | 222 | 11011110 |
| 190 | 10111110 | 166 | 10100110 | 254 | 11111110 | 223 | 11011111 |
| 191 | 10111111 | 167 | 10100111 | 255 | 11111111 | 224 | 11100000 |

FIG. 17

(SELECTIVE ERASURE)

| CONVERSION TABLE OF SECOND DATA CONVERSION CIRCUIT 34 | | | | | | | | | | | | | | | LIGHT-EMISSION DRIVE PATTERN IN ONE FIELD | | | | | | | | | | | | | | LIGHT-EMISSION BRIGHT-NESS |
|---|---|---|---|---|---|---|---|---|---|---|---|---|---|---|---|---|---|---|---|---|---|---|---|---|---|---|---|---|---|
| PDs | GD | | | | | | | | | | | | | | SF 1 | SF 2 | SF 3 | SF 4 | SF 5 | SF 6 | SF 7 | SF 8 | SF 9 | SF 10 | SF 11 | SF 12 | SF 13 | SF 14 | |
| | 1 | 2 | 3 | 4 | 5 | 6 | 7 | 8 | 9 | 10 | 11 | 12 | 13 | 14 | | | | | | | | | | | | | | | |
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLES : SELECTIVE ERASE DISCHARGE STATE
WHITE CIRCLES : LIGHT-EMITTING STATE

FIG. 21

(SELECTIVE WRITING)

| CONVERSION TABLE OF SECOND DATA CONVERSION CIRCUIT 34 | | | | | | | | | | | | | | | LIGHT-EMISSION DRIVE PATTERN IN ONE FIELD | | | | | | | | | | | | | | LIGHT-EMISSION BRIGHTNESS |
|---|---|---|---|---|---|---|---|---|---|---|---|---|---|---|---|---|---|---|---|---|---|---|---|---|---|---|---|---|---|
| PDs | GD | | | | | | | | | | | | | | SF 14 | SF 13 | SF 12 | SF 11 | SF 10 | SF 9 | SF 8 | SF 7 | SF 6 | SF 5 | SF 4 | SF 3 | SF 2 | SF 1 | |
| | 14 | 13 | 12 | 11 | 10 | 9 | 8 | 7 | 6 | 5 | 4 | 3 | 2 | 1 | | | | | | | | | | | | | | | |
| 0000 | 0 | 0 | 0 | 0 | 0 | 0 | 0 | 0 | 0 | 0 | 0 | 0 | 0 | 0 | | | | | | | | | | | | | | | 0 |
| 0001 | 0 | 0 | 0 | 0 | 0 | 0 | 0 | 0 | 0 | 0 | 0 | 0 | 0 | 1 | | | | | | | | | | | | | | ● | 1 |
| 0010 | 0 | 0 | 0 | 0 | 0 | 0 | 0 | 0 | 0 | 0 | 0 | 0 | 1 | 0 | | | | | | | | | | | | | ● | ○ | 4 |
| 0011 | 0 | 0 | 0 | 0 | 0 | 0 | 0 | 0 | 0 | 0 | 0 | 1 | 0 | 0 | | | | | | | | | | | | ● | ○ | ○ | 9 |
| 0100 | 0 | 0 | 0 | 0 | 0 | 0 | 0 | 0 | 0 | 0 | 1 | 0 | 0 | 0 | | | | | | | | | | | ● | ○ | ○ | ○ | 17 |
| 0101 | 0 | 0 | 0 | 0 | 0 | 0 | 0 | 0 | 0 | 1 | 0 | 0 | 0 | 0 | | | | | | | | | | ● | ○ | ○ | ○ | ○ | 27 |
| 0110 | 0 | 0 | 0 | 0 | 0 | 0 | 0 | 0 | 1 | 0 | 0 | 0 | 0 | 0 | | | | | | | | | ● | ○ | ○ | ○ | ○ | ○ | 40 |
| 0111 | 0 | 0 | 0 | 0 | 0 | 0 | 0 | 1 | 0 | 0 | 0 | 0 | 0 | 0 | | | | | | | | ● | ○ | ○ | ○ | ○ | ○ | ○ | 56 |
| 1000 | 0 | 0 | 0 | 0 | 0 | 0 | 1 | 0 | 0 | 0 | 0 | 0 | 0 | 0 | | | | | | | ● | ○ | ○ | ○ | ○ | ○ | ○ | ○ | 75 |
| 1001 | 0 | 0 | 0 | 0 | 0 | 1 | 0 | 0 | 0 | 0 | 0 | 0 | 0 | 0 | | | | | | ● | ○ | ○ | ○ | ○ | ○ | ○ | ○ | ○ | 97 |
| 1010 | 0 | 0 | 0 | 0 | 1 | 0 | 0 | 0 | 0 | 0 | 0 | 0 | 0 | 0 | | | | | ● | ○ | ○ | ○ | ○ | ○ | ○ | ○ | ○ | ○ | 122 |
| 1011 | 0 | 0 | 0 | 1 | 0 | 0 | 0 | 0 | 0 | 0 | 0 | 0 | 0 | 0 | | | | ● | ○ | ○ | ○ | ○ | ○ | ○ | ○ | ○ | ○ | ○ | 150 |
| 1100 | 0 | 0 | 1 | 0 | 0 | 0 | 0 | 0 | 0 | 0 | 0 | 0 | 0 | 0 | | | ● | ○ | ○ | ○ | ○ | ○ | ○ | ○ | ○ | ○ | ○ | ○ | 182 |
| 1101 | 0 | 1 | 0 | 0 | 0 | 0 | 0 | 0 | 0 | 0 | 0 | 0 | 0 | 0 | | ● | ○ | ○ | ○ | ○ | ○ | ○ | ○ | ○ | ○ | ○ | ○ | ○ | 217 |
| 1110 | 1 | 0 | 0 | 0 | 0 | 0 | 0 | 0 | 0 | 0 | 0 | 0 | 0 | 0 | ● | ○ | ○ | ○ | ○ | ○ | ○ | ○ | ○ | ○ | ○ | ○ | ○ | ○ | 255 |

BLACK CIRCLES : SELECTIVE WRITE DISCHARGE + LIGHT-EMITTING STATE

WHITE CIRCLES : LIGHT-EMITTING STATE

METHOD FOR DRIVING PLASMA DISPLAY PANEL

BACKGROUND OF THE INVENTION

1. Field of the Invention

The present invention relates to a method for driving a plasma display panel.

2. Description of Related Art

In recent years, display devices have been required to provide reduced thickness as the devices have been increased in size, and accordingly various types of thin display devices have been in practical use. Attention is focused on an AC discharge plasma display panel as one of the thin display devices.

FIG. 1 is a schematic view illustrating the configuration of a plasma display device comprising such a plasma display panel and a drive device.

Referring to FIG. 1, the plasma display panel or a PDP 10 comprises m column electrodes $D_1$ to $D_m$, and n row electrodes $X_1$ to $X_n$ and n row electrodes $Y_1$ to $Y_n$, each of which intersects the column electrodes. These row electrodes $X_1$ to $X_n$ and row electrodes $Y_1$ to $Y_n$ allow a pair of row electrode $X_i$ ($1 \leqq i \leqq n$) and row electrode $Y_i$ ($1 \leqq i \leqq n$) to form the first to nth display line in the PDP 10. In between a column electrode D and row electrodes X, Y, there is formed a discharge space in which a discharge gas is sealed. There is formed a display cell acting as a pixel at the intersection of each pair of row electrodes and a column electrode, including the discharge space.

With this construction, each display cell emits light through a discharge phenomenon and therefore has only two states, or a "light-emitting" state and a "non-light-emitting" state. Accordingly, the display cell can express the brightness of only two levels of gray scale, or a minimum brightness ("non-light-emitting" state) and a maximum brightness ("light-emitting" state).

In this regard, for the implementation of displaying halftone brightness corresponding to an input video signal, a driver 100 employs a subfield method to perform gray scale drive on the PDP 10 mentioned above.

According to the subfield method, for example, an input video signal is converted into display data of four bits corresponding to each display cell. As shown in FIG. 2, one field comprises four subfields SF1 to SF4 corresponding to each bit digit of the four bits. Then, in each of the subfields, as described below, a simultaneous reset process Rc, a data write process Wc, a light-emission sustain process Ic, and an erase process E are performed, respectively.

FIG. 3. is a view illustrating various types of drive pulses that the driver 100 applies to the aforementioned PDP 10, and the application timing of the drive pulses.

First, in the aforementioned simultaneous reset process Rc, the driver 100 applies a positive reset pulse $RP_X$ to the row electrodes $X_1$ to $X_n$ and a negative reset pulse $RP_Y$ to the row electrodes $Y_1$ to $Y_n$. The application of these reset pulses $RP_X$ and $RP_Y$ will cause all display cells of the PDP 10 to be reset and discharged, allowing a predetermined uniform wall charge to be built in each of the display cells. Immediately thereafter, the driver 100 applies simultaneously an erasing pulse EP to the row electrodes $X_1$ to $X_n$ of the PDP 10. The application of the erasing pulse EP will cause an erase discharge to be generated in all of the display cells, thereby erasing the aforementioned wall charge. This will reset all the display cells to the state in which no light emission (sustain discharge) is allowed (hereinafter referred to as the "non-light-emitting cell" state) in the light-emission sustain process Ic, described later.

Then, in the data write process Wc, the driver 100 separates each bit of the aforementioned display data of four bits corresponding to each of the subfields SF1 to SF4 to generate a data pulse having a pulse voltage corresponding to the logic level of the bits. For example, in the data write process Wc of the subfield SF1, the driver 100 generates a data pulse having a pulse voltage corresponding to the logic level of the first bit of the aforementioned display data. At this time, the driver 100 generates a high-voltage data pulse with the logic level of the first bit being "1", and a low-voltage (zero volt) data pulse with the logic level being "0". Then, as shown in FIG. 3, the driver 100 successively applies such data pulses to the column electrodes $D_1$ to $D_m$ as a group of data pulses $DP_1$ to $DP_n$ for each display line corresponding to each of the first to nth display lines. Furthermore, as shown in FIG. 3, the driver 100 generates a negative scanning pulse SP in phase with the application timing of each group of data pulses DP to apply successively the negative scanning pulse SP to the row electrodes Y1 to Yn. At this time, discharge (selective write discharge) is caused only at the display cells located at the intersections of the display lines to which the scanning pulse SP is applied and the "columns" to which the high-voltage data pulse is applied. After such a selective write discharge has been terminated, wall charges are built up in the display cells and held. This causes the display cells that have been reset to the "non-light-emitting cell" state in the aforementioned simultaneous reset process Rc to change to the state (hereinafter referred to as the "light-emitting cell" state) in which the display cells can emit light (sustain discharge) in the light-emission sustain process Ic, described later. On the other hand, no such a selective write discharge described above is generated in the display cells to which the scanning pulse SP or the low-voltage data pulse has been applied, allowing the state that has been reset in the aforementioned simultaneous reset process Rc or the "non-light-emitting cell" state to be held.

Subsequently, as shown in FIG. 3, in the light-emission sustain process Ic, the driver 100 applies the positive sustain pulse IPX and the positive sustain pulse $IP_Y$ alternately to the row electrodes $X_1$ to $X_n$ and the row electrodes $Y_1$ to $Y_n$, respectively. Incidentally, as shown in FIG. 2, the number of times (or the duration) of application of the sustain pulses $IP_X$ and $IP_Y$ in one subfield is set according to the weight of each subfield. Here, only the display cells in which wall charges are present or only the display cells in the "light-emitting cell" state perform sustain discharge every time the aforementioned sustain pulses $IP_X$ and $IP_Y$ are applied thereto in order to sustain the "light-emitting" state involved in the discharge.

Subsequently, in the erase process E, the driver 100 applies simultaneously the negative erasing pulse EP, shown in FIG. 3, to each of the row electrodes $Y_1$ to $Y_n$. This allows an erase discharge in all the display cells to be generated, causing all the wall charges remaining in each of the display cells to dissipate.

Execution of the series of these operations in each of the subfields (SF1 to SF4) will allow halftone brightness to be viewed in accordance with the total number of times of light emission carried out in the light-emission sustain process Ic of each subfield. For example, for the four subfields as mentioned above, it is possible to express the range of brightness available to an input video signal with 16 levels of halftone brightness by combining the subfields that are allowed to emit light in the light-emission sustain process Ic. At this time, the greater the number of subfields to be provided by division, the greater the number of steps or the level of gray scale becomes, thereby making it possible to provide a display image of higher quality.

However, since the display period of one field is specified, the number of subfields provided by dividing a field cannot be increased without limitation.

In addition, in the drive shown in FIGS. 2 and 3, a light emission pattern for providing display brightness of brightness level "7" shown in FIG. 4 is inverted with respect to that for providing display brightness of brightness level "8" in one field period. In some cases, this would cause false contours to be viewed in the image.

That is, as shown in FIG. 4, the display cells for displaying brightness level "7" are in the "non-light-emitting" state while the display cells for displaying brightness level "8" are emitting light in one field. On the other hand, the display cells for displaying brightness level "8" are in the "non-light-emitting" state while the display cells for displaying brightness level "7" are emitting light in one field.

Thus, looking at the display cells for displaying brightness level "8" immediately before the display cells for displaying brightness level "8" change from the "non-light-emitting" to the "light-emitting" state would cause the viewer to continuously view only the "non-light-emitting" state of both display cells and thereby to recognize dark lines on the boundary thereof. These dark lines, having nothing to do with the display data, would appear as false contours to cause degradation in display quality.

OBJECTS AND SUMMARY OF THE INVENTION

The present invention has been made to solve the aforementioned problems. It is therefore an object of the present invention to provide a method for driving plasma display panels, the method being capable of providing improved display quality.

The present invention provides a method for driving a plasma display panel by allowing a display period of one field of an input video signal to comprise a plurality of subfields for halftone drive, the plasma display panel having a display cell acting as a pixel at each intersection of a plurality of row electrodes acting as a display line and a plurality of column electrodes each intersecting each of said row electrodes. Executed first is a reset process, only in a head subfield during the display period of said one field, for initializing said display cell to a light-emitting cell state. Then, in each of said subfields, executed is a data write process for applying successively a scanning pulse for generating a selective erase discharge to each of said row electrodes in order to change selectively each of said display cells from said light-emitting cell state to a non-light-emitting cell state in accordance with said input video signal. Then, executed is a light emission sustain process for applying a train of scanning pulses to each of the row electrodes immediately after said scanning pulse has been applied thereto, the train of scanning pulses generating a sustain discharge to allow only a display cell in said light-emitting cell state to emit light for the number of times corresponding to a weight of each of said subfields.

Furthermore, the present invention provides a method for driving a plasma display panel by allowing a display period of one field of an input video signal to comprise a plurality of subfields for halftone drive, the plasma display panel having a display cell acting as a pixel at each intersection of a plurality of row electrodes acting as a display line and a plurality of column electrodes each intersecting each of said row electrodes. Executed first is a reset process, only in a head subfield during the display period of said one field, for initializing said display cell to a non-light-emitting cell state. Then, in each of said subfields, executed is a data write process for applying successively a scanning pulse for generating a selective write discharge to each of said row electrodes in order to change selectively each of said display cells from said non-light-emitting cell state to said light-emitting cell state in accordance with said input video signal. Then, executed is a light emission sustain process for applying a train of scanning pulses to each of the row electrodes immediately after said scanning pulse has been applied thereto, the train of scanning pulses generating a sustain discharge to allow only a display cell in said light-emitting cell state to emit light for the number of times corresponding to a weight of each of said subfields.

BRIEF DESCRIPTION OF THE DRAWINGS

FIG. 9 is a view illustrating the relationship between the brightness mode and the number of times of application of scanning pulses IP in the light-emission sustain process Ic of each of subfields SF1 to SF14;

FIG. 11 is a view illustrating a data conversion table in accordance with the data conversion characteristic shown in FIG. 10;

FIG. 12 is a view illustrating a data conversion table in accordance with the data conversion characteristic shown in FIG. 10;

FIG. 17 is a view showing a conversion table to be used in a second data conversion circuit 34 when a selective erase address method is employed, and a light-emission drive pattern, based on cell drive data GD and provided by the conversion table;

FIG. 21 is a view showing a conversion table to be used in the second data conversion circuit 34 when a selective write address method is employed, and a light-emission drive pattern, based on cell drive data GD and provided by the conversion table.

DETAILED DESCRIPTION OF THE PREFERRED EMBODIMENTS

Now, the present invention will be explained below with reference to the accompanying drawings in accordance with the embodiments.

Figure 1:
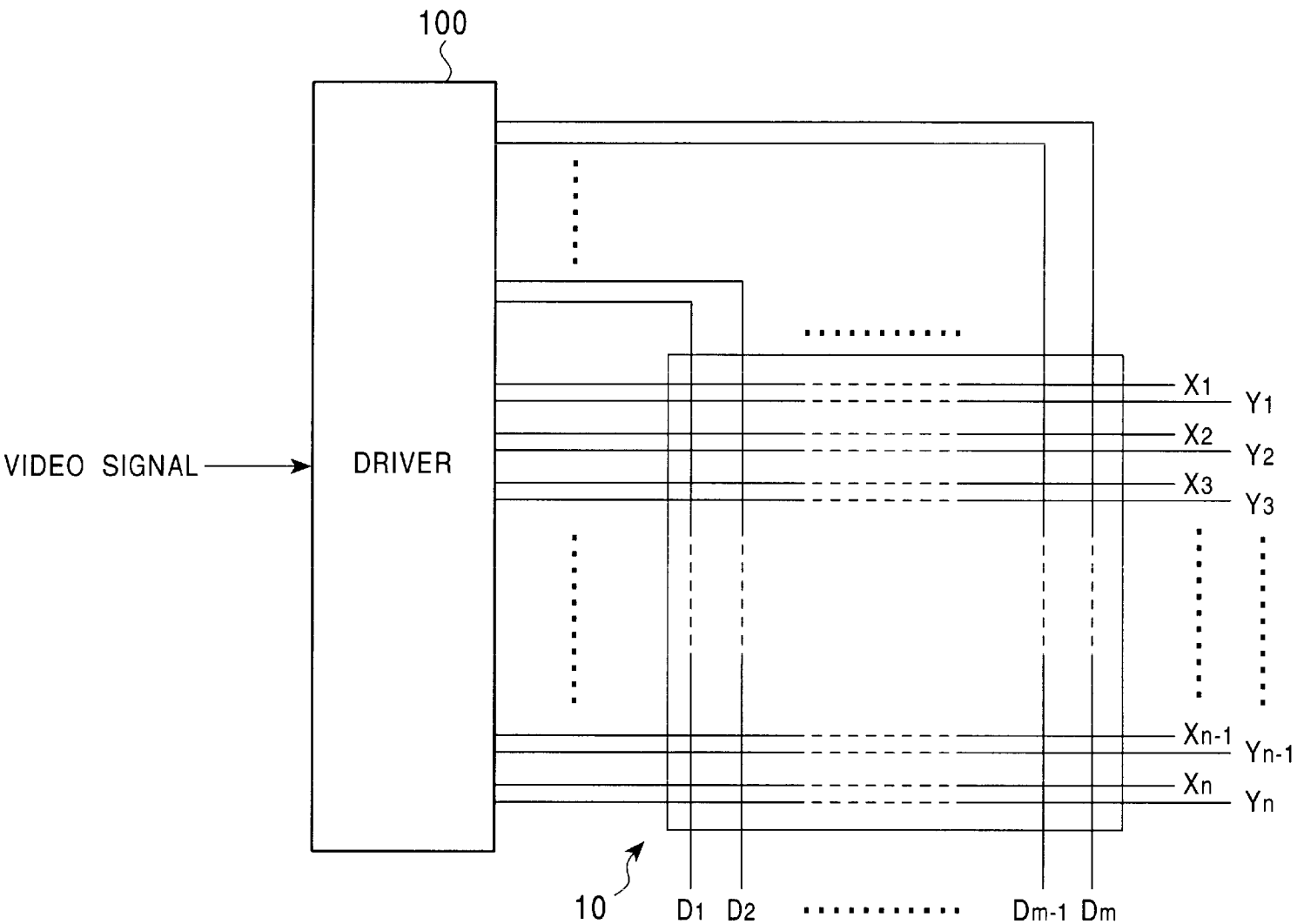
FIG. 1 is a schematic view illustrating the configuration of a plasma display device.
Figure 2:
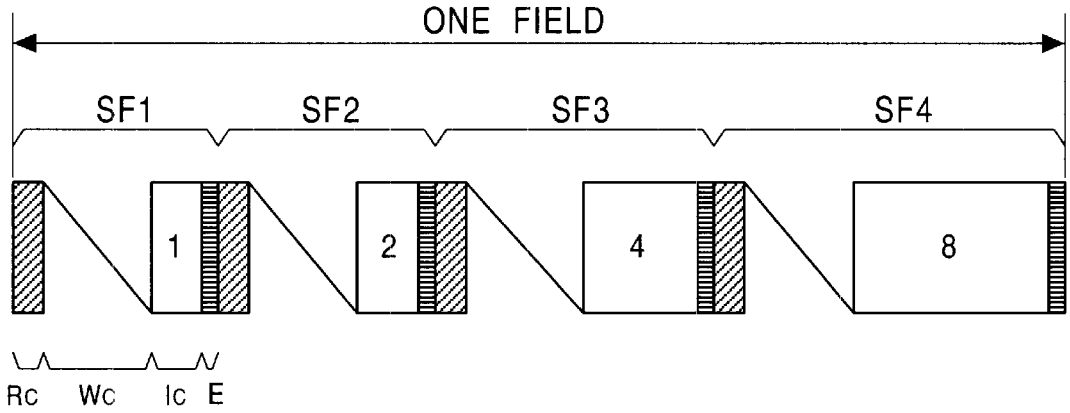
FIG. 2 is a view illustrating an example of a light-emission drive format in accordance with a subfield method.
Figure 3:
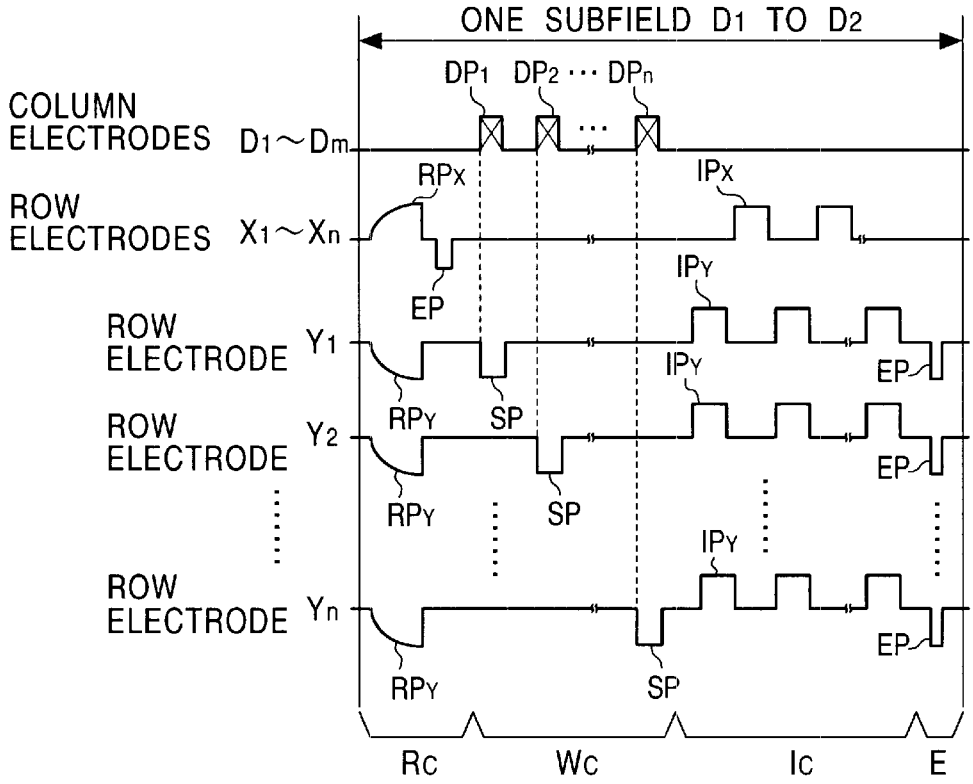
FIG. 3 is a view illustrating various drive pulses to be applied to a PDP 10 and the application timing thereof.
Figure 4:
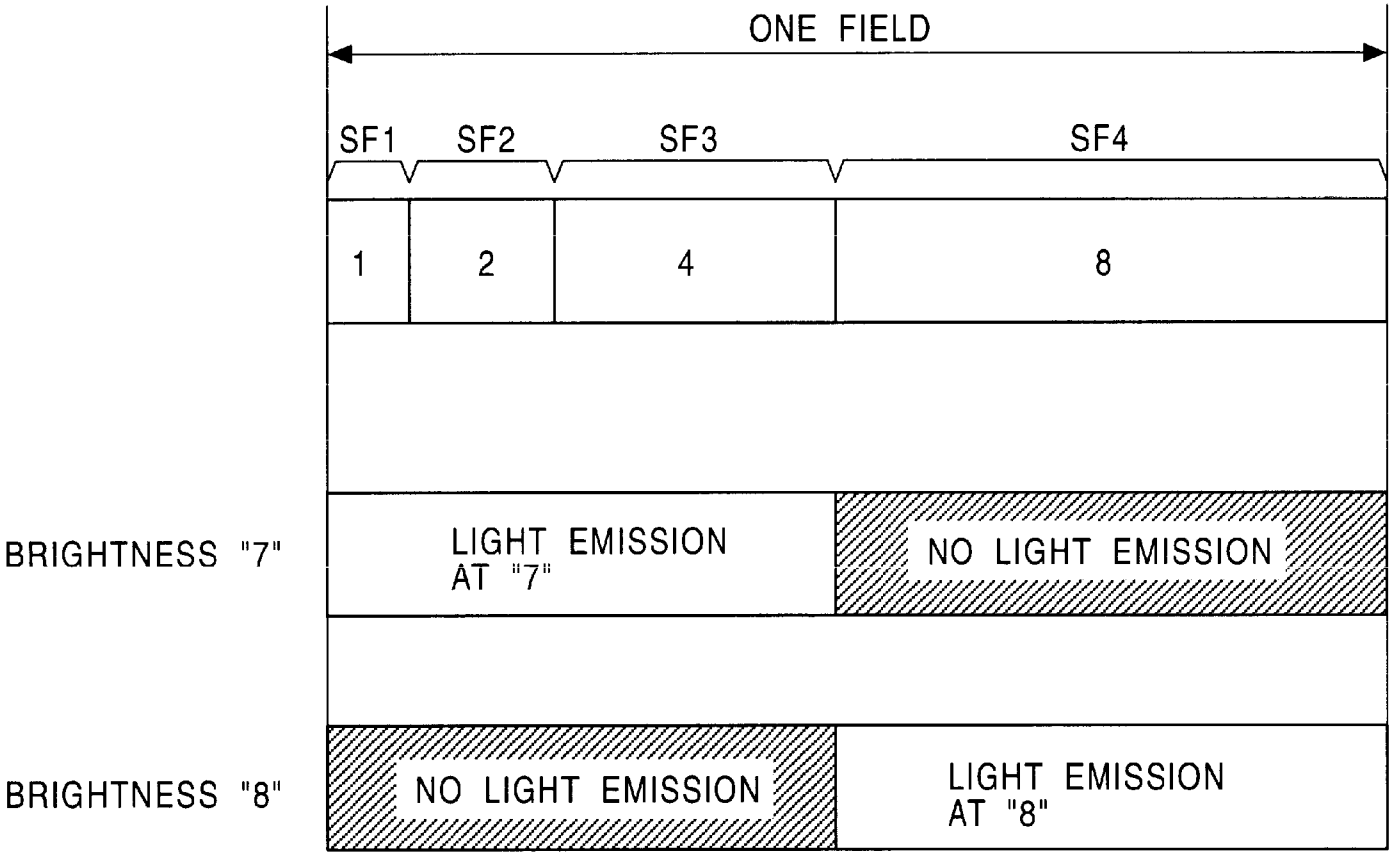
FIG. 4 is a view illustrating an example of a combination of light-emission patterns that causes a false contour.
Figure 5:
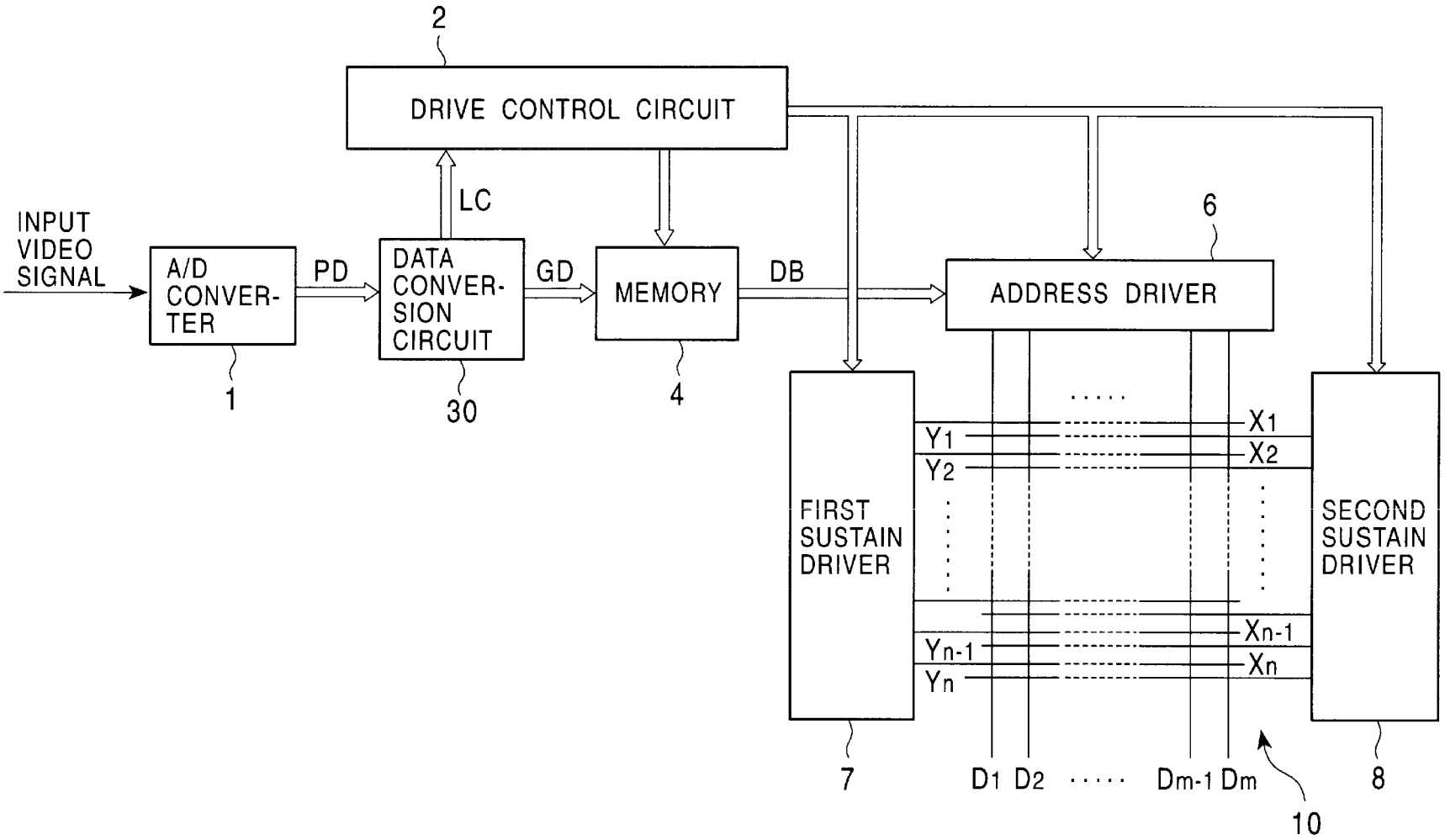
FIG. 5 is a view illustrating the configuration of a plasma display device for driving a plasma display panel in accordance with a drive method according to the present invention.

FIG. 5 is a view showing the general configuration of a plasma display device for gray scale driving a plasma display panel in accordance with a drive method of the present invention.

As shown in FIG. 5, the plasma display device comprises a plasma display panel or a PDP 10 and various types of functional modules for driving the PDP 10.

The PDP 10 comprises discharge spaces (not shown) in which a discharge gas is sealed, and a front glass substrate (not shown) and a rear glass substrate, which sandwich and thereby define the discharge spaces. The front glass substrate serves as the display screen for use with the PDP 10, and on the reverse surface thereof, there are formed row electrodes $X_1$ to $X_n$ and row electrodes $Y_1$ to $Y_n$, respective pairs of which act as one display line and which are parallel to each other as shown in FIG. 5. On the other hand, on the rear glass substrate, there are formed m column electrodes $D_1$ to $D_m$ in the direction intersecting the aforementioned row electrodes X and Y. A display cell acting as a pixel is formed at the intersection, including the aforementioned discharge space, of each pair of row electrodes and a column electrode.

An A/D converter 1 samples an analog input video signal to convert the video signal into, for example, 8-bit display data PD corresponding to each display cell. Then the resulting data is supplied to a data conversion circuit 30. The data conversion circuit 30 converts the 8-bit display data PD into 14-bit cell drive data GD, which is in turn supplied to a memory 4.

Figure 6:
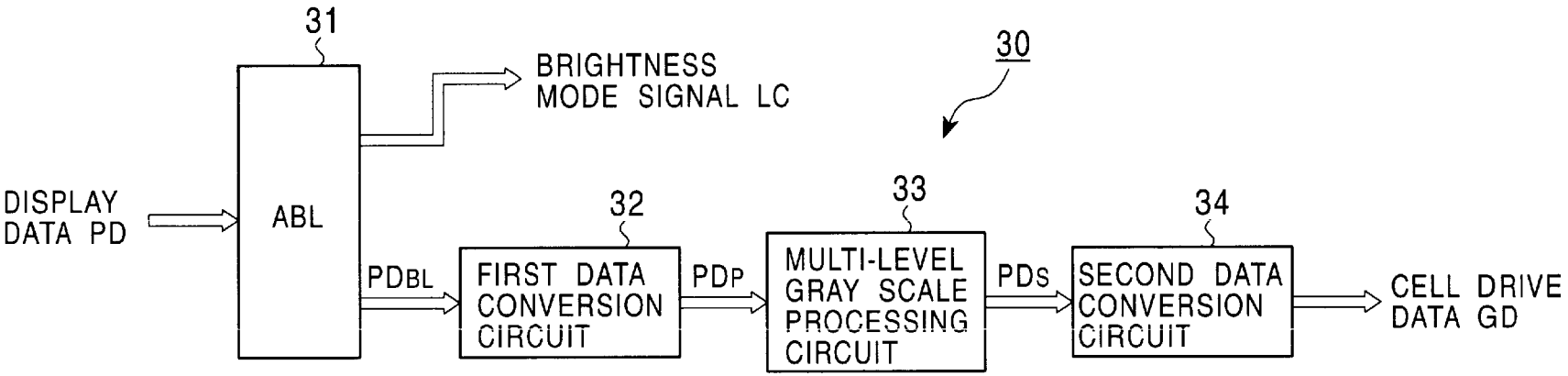
FIG. 6 is a view illustrating the internal configuration of a data conversion circuit 30.

FIG. 6 is a view illustrating the internal configuration of the data conversion circuit 30.

An ABL (automatic brightness control) circuit 31 tunes the brightness level of the display data PD so that the average brightness of the image displayed on the screen of the PDP 10 falls within the predetermined range of brightness. Then, the ABL circuit 31 supplies the brightness tuning display data $PDB_L$ obtained through the tuning of the brightness level.

Figure 7:
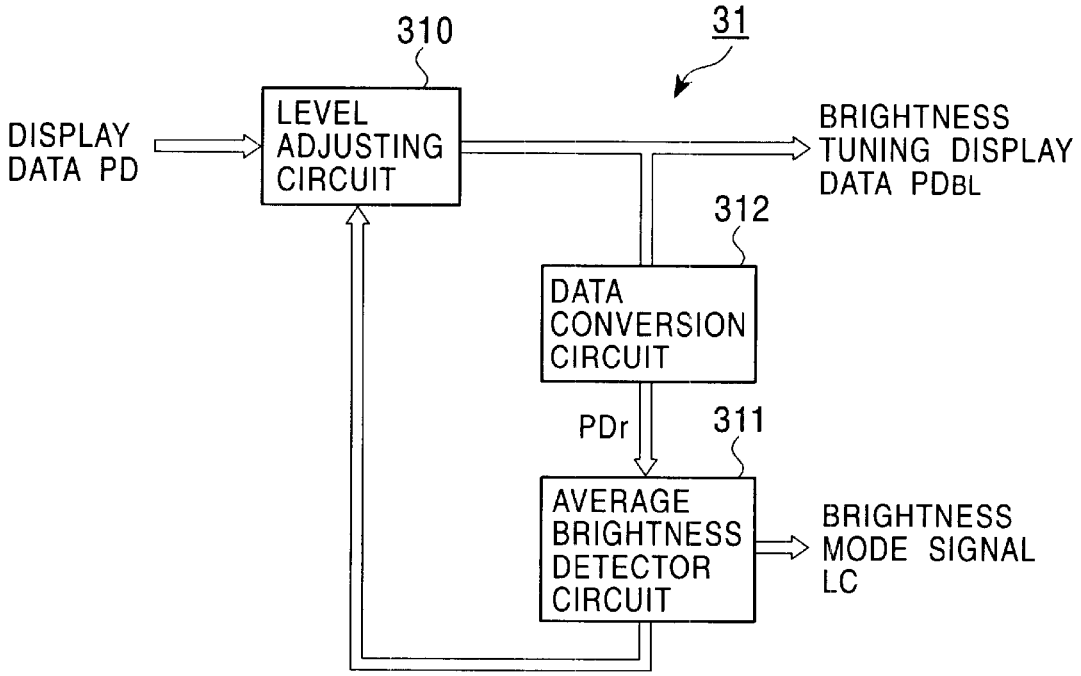
FIG. 7 is a view illustrating the internal configuration of an ABL circuit 31.

FIG. 7 is a view showing the internal configuration of the ABL circuit 31.

Figure 8:
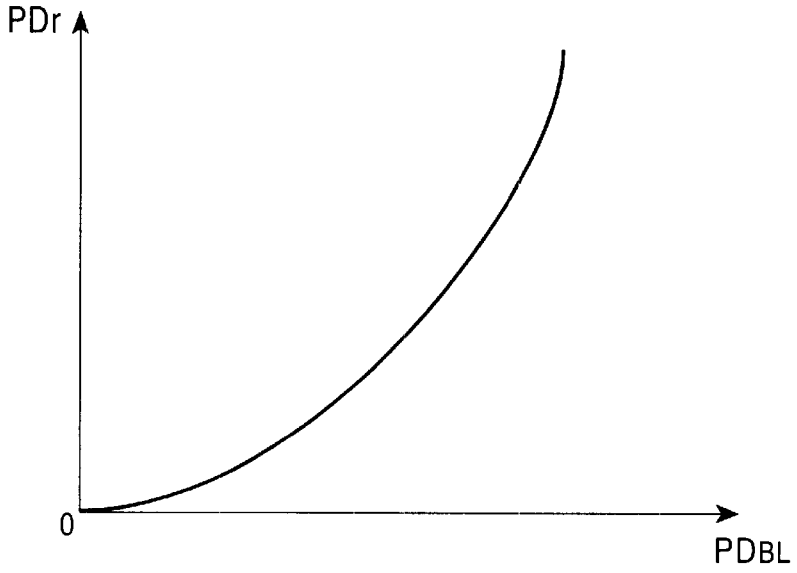
FIG. 8 is a view illustrating the conversion characteristic of a data conversion circuit 312.

Referring to FIG. 7, a data conversion circuit 312 converts the brightness-tuning display data $PD_{BL}$ supplied from a level adjusting circuit 310 into the inverse-Gamma-corrected display data $PD_r$ having the inverse Gamma characteristics ($Y=X^{2.2}$) with the non-linear characteristics as shown in FIG. 8. Then, the data conversion circuit 312 supplies the inverse-Gamma-corrected display data PDr to an average brightness level detector circuit 311. That is, from the aforementioned brightness tuning display data $PD_{BL}$, the data conversion circuit 312 restores display data corresponding to the original video signal of which Gamma correction is undone and then outputs the display data as the inverse-Gamma-corrected display data $PD_r$. First, the average brightness level detector circuit 311 determines the average brightness of the inverse-Gamma-corrected display data $PD_r$ and then selects a brightness mode, which is employed for displaying an image at the brightness (the brightness of the whole screen) in response to the average brightness, from the brightness modes 1 to 4, shown in FIG. 9. Then, the average brightness level detector circuit 311 supplies a brightness mode signal LC indicative of the selected brightness mode to a drive control circuit 2. In addition, the average brightness level detector circuit 311 supplies average brightness information indicative of the average brightness determined as described above to the aforementioned level adjusting circuit 310. The level adjusting circuit 310 tunes the brightness level of the display data PD in accordance with the average brightness information to obtain the aforementioned brightness tuning display data $PD_{BL}$, which is in turn supplied to the aforementioned data conversion circuit 312. Moreover, as shown in FIG. 6, the level adjusting circuit 310 supplies the brightness tuning display data $PD_{BL}$ to a first data conversion circuit 32 provided in the following stage.

Figure 10:
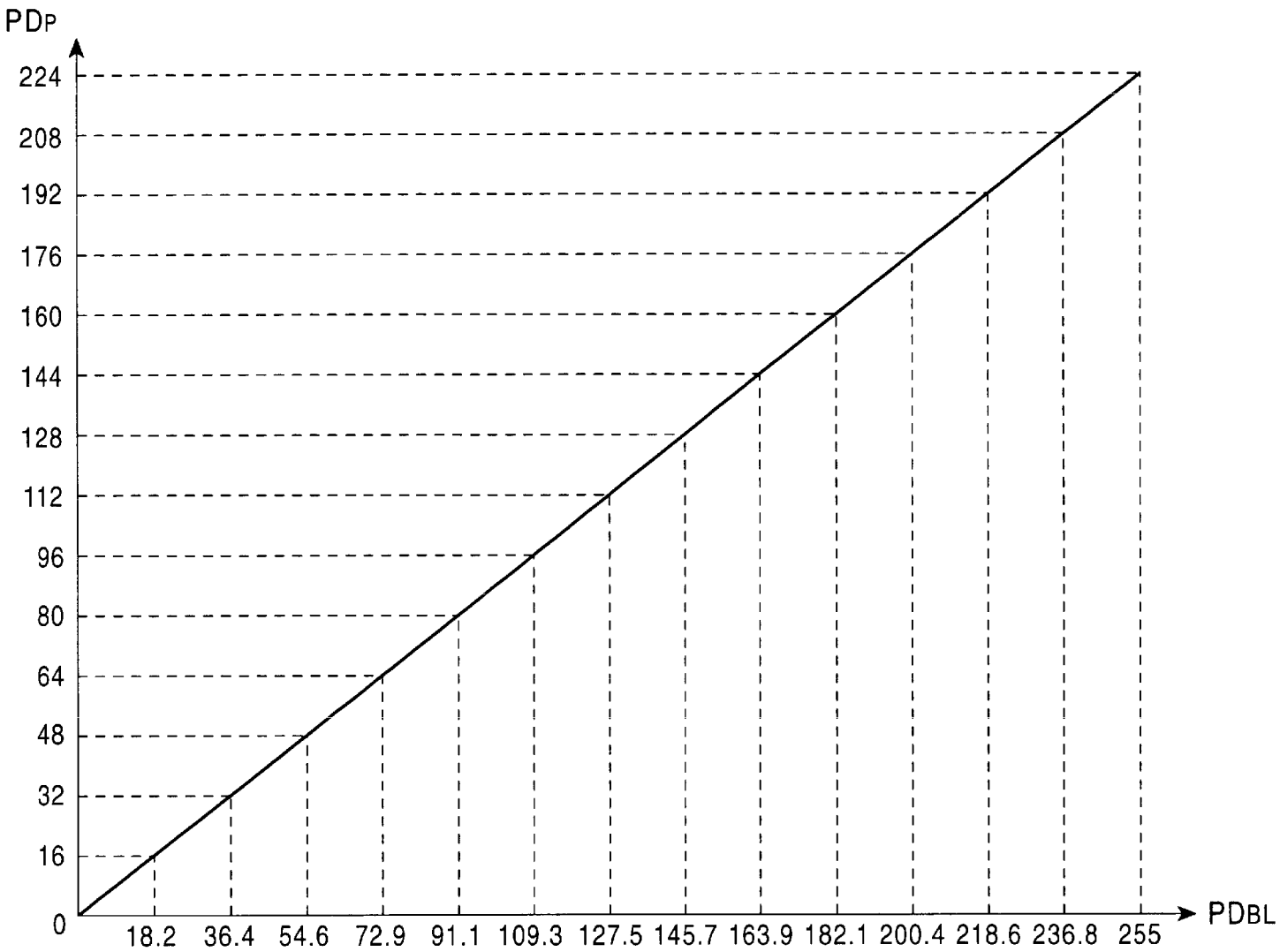
FIG. 10 is a view illustrating the data conversion characteristic of a first data conversion circuit 32.

In accordance with the conversion characteristic as shown in FIG. 10, the first data conversion circuit 32 suppresses the aforementioned brightness tuning display data $PD_{BL}$ to (224/225), which allows for expressing 256 levels of gray scale with 8 bits, and then supplies the resulting data to a multi-level gray scale processing circuit 33 as the brightness suppressing display data $PD_P$. More specifically, in accordance with the conversion tables shown in FIGS. 11 and 12, which are based on the aforementioned conversion characteristic, the first data conversion circuit 32 converts the brightness tuning display data $PD_{BL}$ to the brightness suppressing display data $PD_P$. This prevents the occurrence of brightness saturation caused by the multi-gray-scale processing performed by the multi-level gray scale processing circuit 33 and the occurrence of a flat portion in display characteristic (or distortion in level of gray scale), which is caused when a display level of gray scale is not present on bit boundaries.

Figure 13:
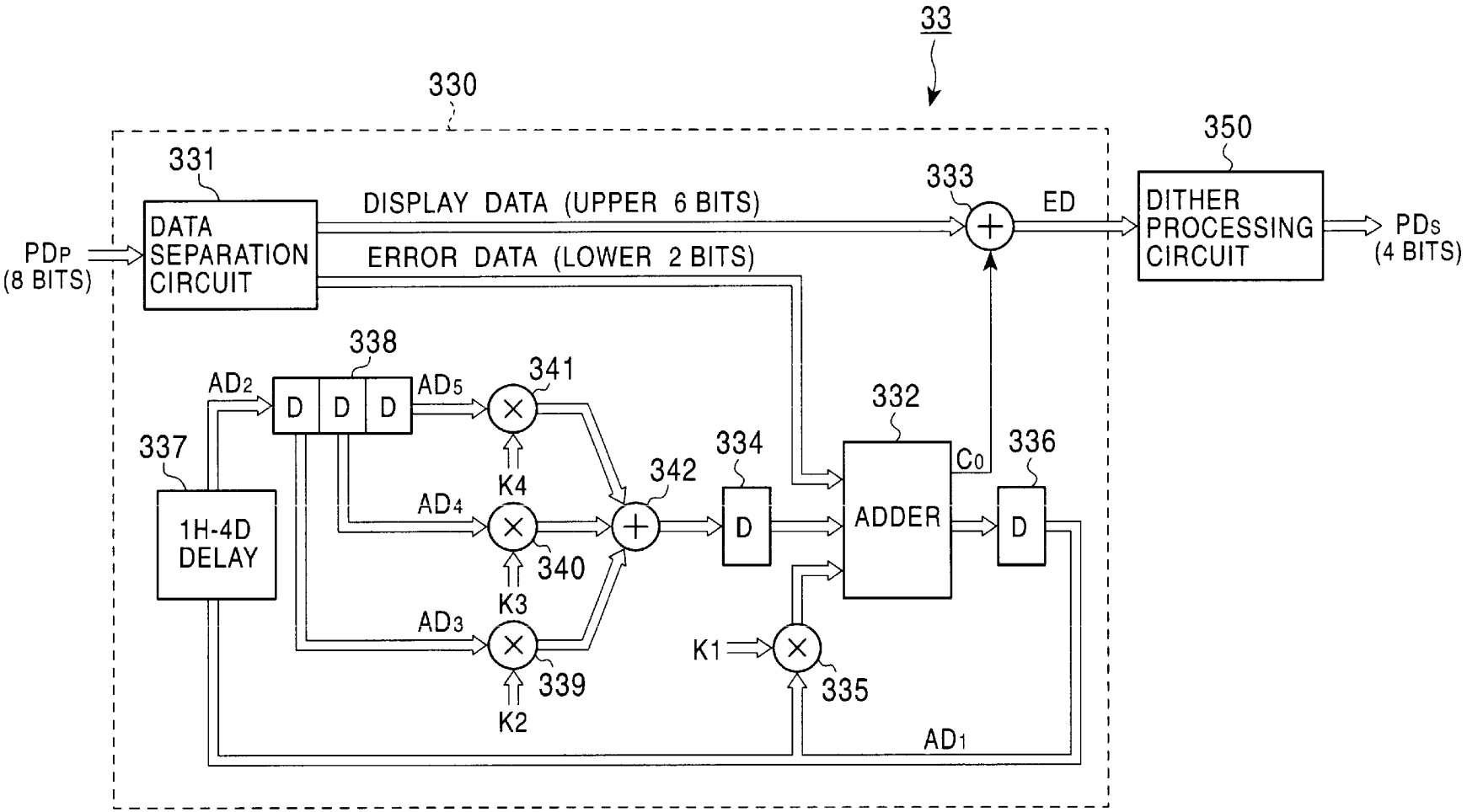
FIG. 13 is a view illustrating the internal configuration of a multi-level gray scale processing circuit 33.

FIG. 13 is a view showing the internal configuration of the multi-level gray scale processing circuit 33.

As shown in FIG. 13, the multi-level gray scale processing circuit 33 comprises an error diffusion-processing circuit 330 and a dither processing circuit 350.

A data separation circuit 331 of the error diffusion processing circuit 330 separates the lower 2 bits of the 8-bit brightness suppressing display data $PD_P$ supplied by the aforementioned first data conversion circuit 32 into error data and the upper 6 bits into main display data. Then, the data separation circuit 331 supplies the main display data to an adder 333 and the aforementioned error data to an adder 332. The adder 332 supplies, to a delay circuit 336, the sum obtained by adding the error data, the delay output from a delay circuit 334, and a multiplication output of a coefficient multiplier 335. The delay circuit 336 causes the sum supplied by the adder 332 to be delayed by a delay time D of the same length of time as the sampling period of the display data PD. Then, the delay circuit 336 supplies the sum to the aforementioned coefficient multiplier 335 and the delay circuit 337 as a delayed signal $AD_1$, respectively. The coefficient multiplier 335 multiplies the aforementioned delayed signal $AD_1$ by the predetermined coefficient $K_1$ (for example, "7/16") and then supplies the resulting value to the aforementioned adder 332. The delay circuit 337 causes further the aforementioned delayed signal $AD_1$ to be delayed by the time (equal to one horizontal scan period—the aforementioned delay time D×4) and then supplies the resulting value to a delay circuit 338 as a delayed signal $AD_2$. The delay circuit 338 causes further the delayed signal $AD_2$ to be delayed by the aforementioned delay time D and then supplies the resulting value to a coefficient multiplier 339 as a delayed signal $AD_3$. Moreover, the delay circuit 338 causes further the delayed signal $AD_2$ to be delayed by the aforementioned delay time D×2 and then supplies the resulting value to a coefficient multiplier 340 as a delayed signal $AD_4$. Still moreover, the delay circuit 338 causes the delayed signal $AD_2$ to be delayed by the aforementioned delay time D×3 and then supplies the resulting value to a coefficient multiplier 341 as a delayed signal $AD_5$. The coefficient multiplier 339 multiplies the aforementioned delayed signal $AD_3$ by the predetermined coefficient $K_2$ (for example, "3/16") and then supplies the resulting value to an adder 342. The coefficient multiplier 340 multiplies the aforementioned delayed signal $AD_4$ by the predetermined coefficient $K_3$ (for example, "5/16") and then supplies the resulting value to the adder 342. The coefficient multiplier 341 multiplies the aforementioned delayed signal $AD_5$ by the predetermined coefficient $K_4$ (for example, "1/16") and then supplies the resulting value to the adder 342. The adder 342 supplies, to the aforementioned delay circuit 334, the sum signal that has been obtained by adding the results of multiplication supplied by the aforementioned respective coefficient multipliers 339, 340, and 341. The delay circuit 334 causes such a sum signal to be delayed by the aforementioned delay time D and then supplies the resulting value signal to the aforementioned adder 332. The adder 332 adds the aforementioned error data (lower two bits of the brightness suppressing display data $PD_P$), the delay output from the delay circuit 334, and the output of multiplication of the coefficient multiplier 335. Then, the adder 332 generates a carry-out signal Co of logic "0" in absence of carry as the result of the addition and a carry-out signal Co of logic level "1" in the presence of carry and supplies the signal to the adder 333. The adder 333 adds the aforementioned main display data (upper 6 bits of the brightness suppressing display data $PD_P$) to the aforementioned carry-out signal Co and outputs the resulting value as 6-bit error diffusion processing display data ED.

The operation of the error diffusion processing circuit 330 configured as such is to be explained below.

Figure 14:
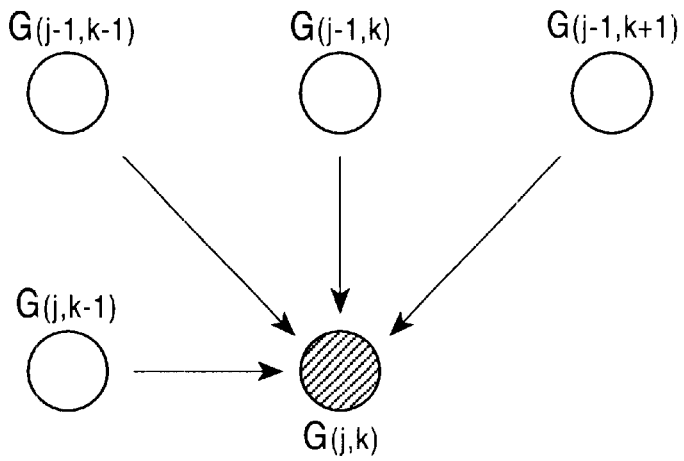
FIG. 14 is an explanatory view showing the operation of an error diffusion processing circuit 330.

For example, the error diffusion processing display data ED corresponding to pixel G (j, k) of the PDP 10 shown in FIG. 14 is determined. In this case, first, the respective pieces of the error data corresponding to pixel G (j, k−1) on the left of the pixel G (j, k), pixel G (j−1, k−1) on the upper left, pixel G (j−1, k) on the immediate above, and pixel G (j−1, k+1) on the upper right, that is:

Error data corresponding to the pixel G (j, k−1), the delayed signal $AD_1$;

Error data corresponding to the pixel G (j−1, k+1), the delayed signal $AD_3$;

Error data corresponding to the pixel G (j−1, k), the delayed signal $AD_4$; and Error data corresponding to the pixel G (j−1, k−1), the delayed signal $AD_5$ are assigned the weights of the predetermined coefficients $K_1$ to $K_4$ for addition. Subsequently, the result of the addition is added by the error data corresponding to the lower two bits of the brightness suppressing display data $PD_P$ or pixel G (j, k). Then, the carry-out signal Co of one bit thus obtained is added to the display data corresponding to the upper six bits of the brightness suppressing display data $PD_P$ or the pixel G (j, k) and the resulting value is employed as the error diffusion processing display data ED.

The error diffusion processing circuit 330 assigns weights (lower two bits of the brightness suppressing display data $PD_P$) to and then adds the respective pieces of error data of the surrounding pixels {G (j, k−1), G (j−1, k+1), G (j−1, k), G (j−1, k−1)}, and the resulting value is reflected to the aforementioned display data of the aforementioned pixel G (j, k) (upper six bits of the brightness suppressing display data $PD_P$). This operation allows the brightness of the lower 2 bits at the original pixel {G (j, k)} to be expressed by the aforementioned surrounding pixels in an apparent manner. Therefore, this allows the display data of the number of bits less than 8 bits or equal to 6 bits to express the levels of gray scale of brightness equivalent to those expressed by the aforementioned 8-bit display data.

Incidentally, an even addition of these coefficients of error diffusion to respective pixels would cause the noise resulting from error diffusion patterns to be visually noticed in some cases and thus the display quality to be degraded. In this regard, like the case of the dither coefficients to be described later, the coefficients $K_1$ to $K_4$ of error diffusion that should be assigned to respective four pixels may be changed at each field.

The dither processing circuit 350 performs the dither processing on the error diffusion processing display data ED supplied by the error diffusion processing circuit 330. This allows for generating the multi-level gray scale processing display data $PD_s$, the number of bits of which is reduced further to 4 bits. Meanwhile, the dither processing circuit 350 maintains the level of gray scale of the same brightness as that of the 6-bit error diffusion processing display data ED. Incidentally, the dither processing allows a plurality of adjacent pixels to express one intermediate display level. For example, suppose that display of gray scale equivalent to 8 bits is performed using the display data of upper 6 bits out of 8-bit display data. In this case, four pixels adjacent to each other on the right and left, and above and below are taken as one set. Four dither coefficients a to d having values different from each other are assigned to respective pieces of the display data corresponding to each of the pixels in the set for addition. The dither processing is to generate four different combinations of intermediate display levels with four pixels. Therefore, even with the number of bits of the display data equal to 6 bits, the brightness levels of gray scale available for display are 4 times or halftone display corresponding to 8 bits becomes available.

However, an even addition of the dither patterns with the coefficients a to d to respective pixels would cause the noise resulting from the dither patterns to be visually noticed and thus the display quality to be degraded.

In this regard, the dither processing circuit 350 changes the dither coefficients a to d that should be assigned to respective four pixels at each field.

Figure 15:
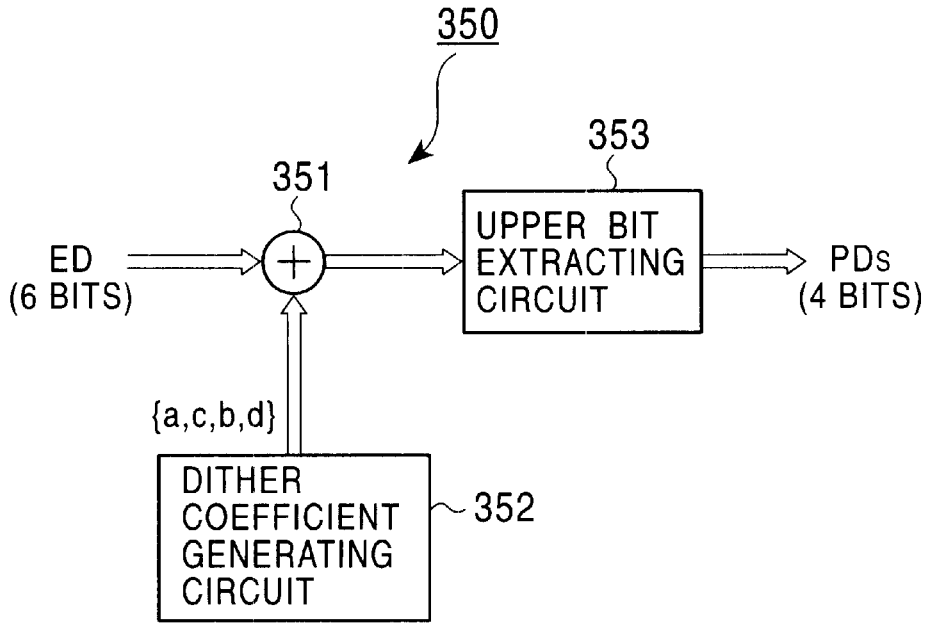
FIG. 15 is a view showing the internal configuration of a dither processing circuit 350.

FIG. 15 is a view showing the internal configuration of the dither processing circuit 350.

Referring to FIG. 15, a dither coefficient generating circuit 352 generates four dither coefficients a, b, c, and d for each of four pixels adjacent to each other and supplies these coefficients in sequence to an adder 351.

Figure 16:
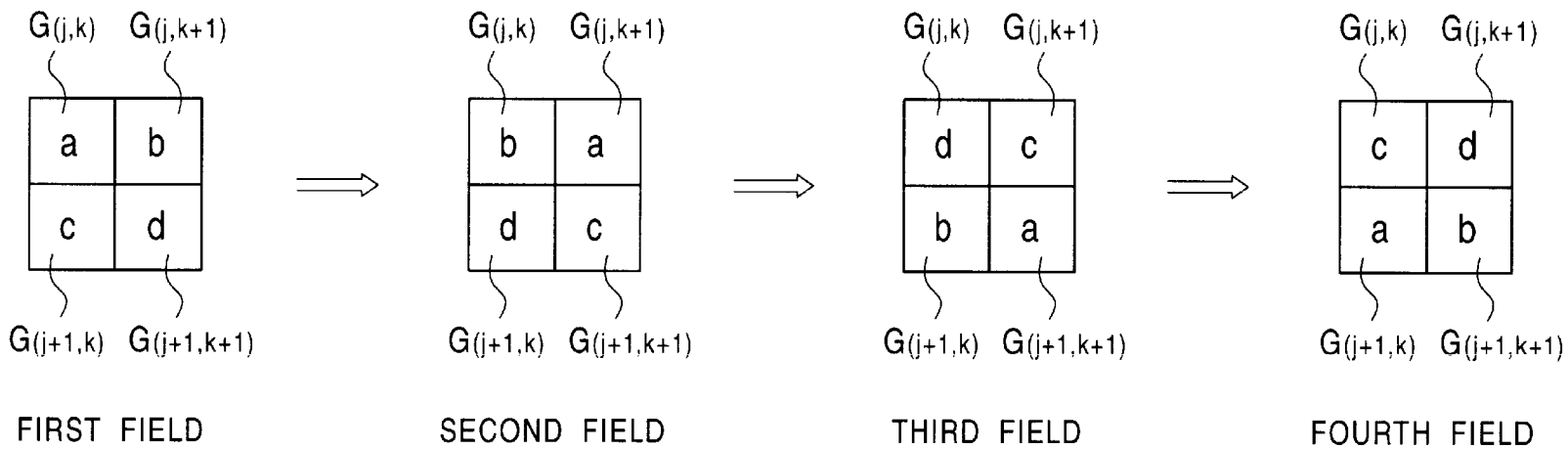
FIG. 16 is an explanatory view showing the operation of the dither processing circuit 350.

For example, as shown in FIG. 16, four dither coefficients a, b, c, and d are generated corresponding to four pixels, respectively. The four pixels are pixel G (j, k) and pixel G (j, k+1) corresponding to row j, and pixel G (j+1, k) and pixel G (j+1, k+1) corresponding to row (j+1). At this time, the dither coefficient generating circuit 352 changes, for each field as shown in FIG. 16, the aforementioned dither coefficients a, b, c, and d that should be assigned to the respective four pixels.

That is, dither coefficients a to d are assigned to the pixels at each field and generated repeatedly in a cyclic manner as shown below and supplied to the adder 351.

That is, at the starting first field, pixel G (j, k), dither coefficient a, pixel G (j k+1), dither coefficient b, pixel G (j+1, k), dither coefficient c, and pixel G (j+1, k+1), dither coefficient d;

at the subsequent second field, pixel G (j, k), dither coefficient b, pixel G (j, k+1), dither coefficient a, pixel G (j+1, k), dither coefficient d, and pixel G (j+1, k+1), dither coefficient c;

at the subsequent third field, pixel G (j, k), dither coefficient d, pixel G (j, k+1), dither coefficient c, pixel G (j+1, k), dither coefficient b, and pixel G (j+1, k+1), dither coefficient a;

and, at the fourth field, pixel G (j, k), dither coefficient c, pixel G (j, k+1), dither coefficient d, pixel G (j+1, k), dither coefficient a, and pixel G (j+1, k+1), dither coefficient b;

The dither coefficient generating circuit 352 executes repeatedly the operation of the first to fourth fields mentioned above. That is, upon completion of generating the dither coefficients at the fourth field, the above-mentioned operation is repeated all over again from the aforementioned first field.

The adder 351 adds the dither coefficients a to d which are assigned to respective fields as mentioned above to the error diffusion processing display data ED, respectively. Hereupon, the error diffusion processing display data ED correspond to the aforementioned pixel G (j, k), pixel G (j, k+1), pixel G (j+1, k), and pixel G (j+1, k+1), respectively, which are supplied by the aforementioned error diffusion processing circuit 330. The adder 351 then supplies the dither additional display data thus obtained to an upper bit extracting circuit 353.

For example, at the first field shown in FIG. 16, each piece of the following data is supplied sequentially as the dither additional display data to the upper bit extracting circuit 353. That is:

error diffusion processing display data ED corresponding to pixel G (j, k)+dither coefficient a;

error diffusion processing display data ED corresponding to pixel G (j, k+1)+dither coefficient b;

error diffusion processing display data ED corresponding to pixel G (j+1, k)+dither coefficient c; and error diffusion processing display data ED corresponding to pixel G (j+1, k+1)+dither coefficient d.

The upper bit extracting circuit 353 extracts the bits up to the upper four bits of the dither additional display data to supply the resulting bits to a second data conversion circuit 34 shown in FIG. 6 as the multi-level gray scale display data $PD_s$.

The second data conversion circuit 34 converts the multi-level gray scale display data $PD_s$ into the cell drive data GD of bit 1 to 14 corresponding to respective subfields SF1 to SF14 in accordance with the conversion table shown in FIG. 17. Incidentally, each of the bits 1 to 14 in the cell drive data GD corresponds to each of the subfields SF1 to SF14, described later. The second data conversion circuit 34 supplies the cell drive data GD to the memory 4 as shown in FIG. 5.

The memory 4 writes sequentially the aforementioned display drive display data GD in accordance with the write signal supplied by the drive control circuit 2. The memory 4 performs the following read operation each time the memory 4 has written a screenful of data or (n×m) pieces of data from cell drive data $GD_{11}$ corresponding to the first row and column to cell drive data $GD_{nm}$ corresponding to the nth row and mth column.

First, the memory 4 interprets the first bit of the cell-drive data $GD_{11}$ to $GD_{nm}$ as cell-drive data bits $DB1_{11}$ to $DD_{nm}$ to read successively the cell-drive data bits $DB1_{11}$ to $DB1_{nm}$ for each display line and supply the bits to an addressing driver 6. Then, the memory 4 interprets the second bit of the cell-drive data $GD_{11}$ to $GD_{nm}$ as cell-drive data bits $DB2_{11}$ to $DB2_{nm}$ to read successively the cell-drive data bits $DB2_{11}$ to $DB2_{nm}$ for each display line and supply the bits to the addressing driver 6. Then, the memory 4 interprets the third bit of the cell-drive data $GD_{11}$ to $GD_{nm}$ as cell-drive data bits $DB3_{11}$ to $DB3_{nm}$ to read successively the cell-drive data bits $DB3_{11}$ to $DB3_{nm}$ for each display line and supply the bits to the addressing driver 6. Subsequently, in the similar manner, the memory 4 interprets the fourth, fifth, . . . fourteenth bit of the cell-drive data $GD_{11}$ to $GD_{nm}$ as cell-drive data bits $DB4_{11}$ to $DB4_{nm}$, $DB5_{11}$ to $DB5_{nm}$, . . . $DB14_{11}$ to $DB14_{nm}$ to read successively the cell-drive data bits $DB4_{11}$ to $DB4_{nm}$, $DB5_{11}$ to $DB5_{nm}$, . . . $DB14_{11}$ to $DB14_{nm}$ for each display line and supply the bits to the addressing driver 6.

Incidentally, the memory 4 performs the reading operation of the aforementioned cell-drive data bits DB1 to DB14 corresponding to each of the subfields SF1 to SF14, described later. That is, the memory 4 reads cell-drive data bits $DB1_{11}$ to $DB1_{nm}$ in subfield SF1, cell-drive data bits $DB2_{11}$ to $DB2_{nm}$ in subfield SF2, and cell-drive data bits $DB3_{11}$ to $DB3_{nm}$ in subfield SF3.

Figure 18:
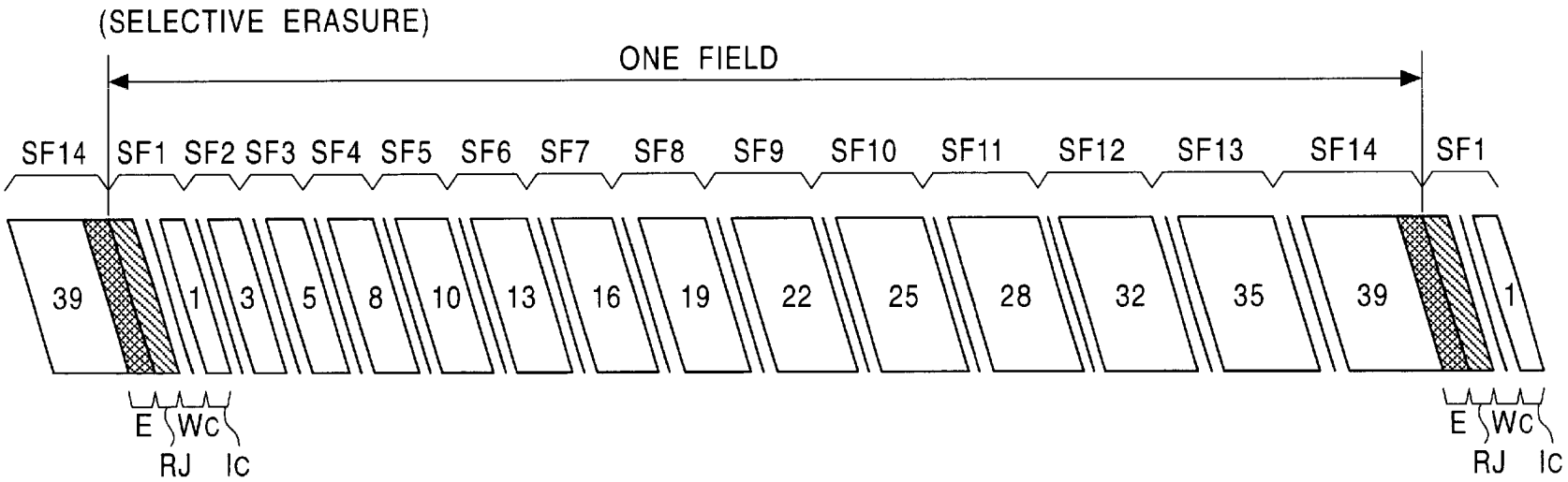
FIG. 18 is a view illustrating a light-emission drive format to be used when the selective erase address method is employed.

The drive control circuit 2 generates various timing signals for driving the levels of gray scale of the PDP 10 and supplies the signals to the addressing driver 6, a first sustain driver 7, and a second sustain driver 8 in accordance with the light-emission drive format shown in FIG. 18.

Incidentally, in the light-emission drive format shown in FIG. 18, a display period of one field (frame) is divided into 14 subfields SF1 to SF14. Then, the data write process Wc and the light-emission sustain process Ic are performed in each of the subfields. Moreover, the simultaneous reset process Rc is executed only in the head subfield SF1 and the erase process E is executed only in the last subfield SF14.

Figure 19:
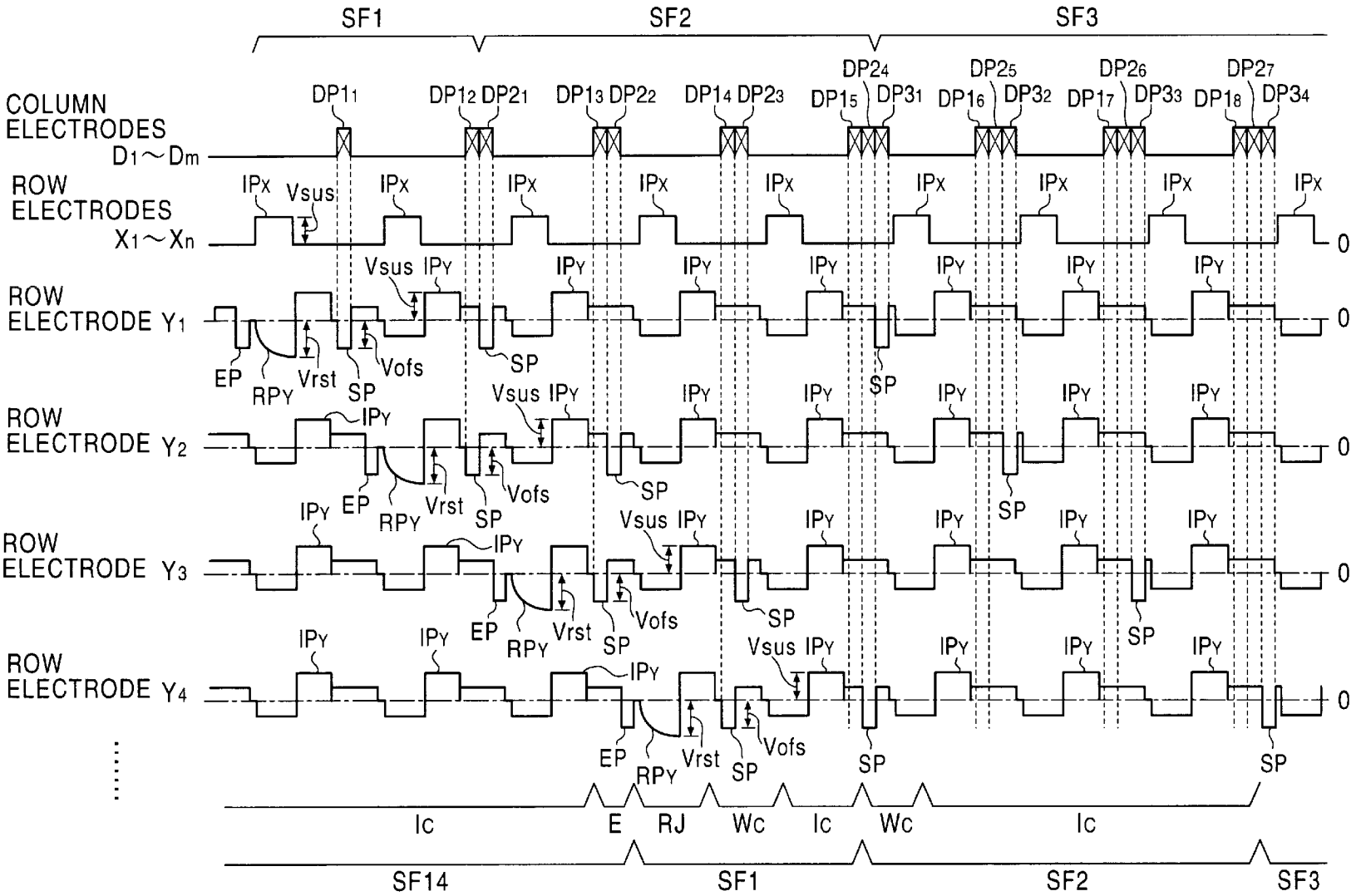
FIG. 19 is a view illustrating various drive pulses to be applied to the PDP 10 in accordance with the light-emission drive format shown in FIG. 18 and the application timing thereof.

FIG. 19 is a view illustrating various drive pulses to be applied to the PDP 10 by each of the addressing driver 6, the first sustain driver 7, and the second sustain driver 8 in accordance with the various types of timing signals supplied from the drive control circuit 2, and the application timing thereof. Incidentally, FIG. 19 shows only the subfields SF1, SF2 and their adjacent subfields, which are extracted from the subfields shown in FIG. 18.

Throughout all periods, the first sustain driver 7 generates repeatedly the sustain pulse $I_X$ having a positive voltage Vsus shown in FIG. 19 at predetermined intervals and applies the sustain pulse IPX to the row electrodes $X_1$ to $X_n$.

Here, only at the head portion of the subfield SF1, the second sustain driver 8 generates the reset pulse $RP_Y$ having a negative voltage $-V_{rst}$ at the same timing as that of the aforementioned sustain pulses $IP_X$ and applies successively the reset pulse $RP_Y$ to the row electrodes $Y_1$ to $Y_n$ as shown in FIG. 19 (reset process RJ).

According to the aforementioned reset process RJ, a reset discharge is generated in each of the display cells on the display line to which the aforementioned reset pulse $RP_Y$ is applied. After the termination of the discharge, wall charges are built up in each of the display cells. That is, each display cell is reset by discharge successively at one display line after another to a state in which light emission (sustain discharge) can be executed in the light-emission sustain process Ic, described later.

Then, immediately after the application of each of the aforementioned reset pulses $RP_Y$, the second sustain driver 8 generates the scanning pulse SP having a negative voltage $-V_{OFS}$ shown in FIG. 19 and applies successively to the row electrodes $Y_1$ to $Y_n$. Incidentally, in the subfields subsequent to the subfield SF2, as soon as the last sustain pulse $IP_Y$ (described later) has been applied to each display line within the subfield immediately before a subfield, the second sustain driver 8 applies the aforementioned scanning pulse SP to the row electrodes Y that are responsible for the display line. Meanwhile, the addressing driver 6 generates a high-voltage data pulse when the aforementioned memory 4 has supplied a cell-drive data bit DB of a logic level of "1", while generating a low-voltage (zero volt) data pulse when the aforementioned memory 4 has supplied a cell-drive data bit DB of a logic level of "0". Then, the data pulse is applied successively to the column electrodes $D_1$ to $D_m$ on one display line after another at the same timing as that of the aforementioned scanning pulse SP (data write process Wc).

For example, in the subfield SF1, the memory 4 supplies the cell-drive data bits $DB1_{11}$to $DB1_{nm}$. Thus, in the data write process Wc of the subfield SF1, the addressing driver applies each of the group of data pulses $DP1_1$ to $DP1_n$, corresponding to the cell-drive data bits $DB1_{11}$ to $DB1_{nm}$, to the column electrodes $D_1$ to $D_m$ successively at the timing of each scanning pulse SP as shown in FIG. 19. In the subfield SF2, the memory 4 supplies the cell-drive data bits $DB2_{11}$ to $DB2_{nm}$ as described above. Thus, in the data write process Wc of the subfield SF2, the addressing driver applies each of the group of data pulses $DP2_1$ to $DP2_n$, corresponding to the cell-drive data bits $DB2_{11}$ to $DB2_{nm}$, to the column electrodes $D_1$ to $D_m$ successively at the timing of each scanning pulse SP as shown in FIG. 19. In the subfield SF3, the memory 4 supplies the cell-drive data bits $DB3_{11}$ to $DB3_{nm}$ as described above. Thus, in the data write process Wc of the subfield SF3, the addressing driver applies each of the group of data pulses $DP3_1$ to $DP3_n$, corresponding to the cell-drive data bits $DB3_{11}$ to $DB3_{nm}$, to the column electrodes $D_1$ to $D_m$ successively at the timing of each scanning pulse SP as shown in FIG. 19.

In the aforementioned data write process Wc, a discharge (selective erase discharge) is caused only at the display cells located at the intersections of the display lines to which the afore scanning pulse SP is applied and the "columns" to which a high-voltage data pulse is applied. The wall charge remaining in the display cells is erased. That is, the display cells in which such a selective erase discharge has been generated change to a state in which light emission (sustain discharge) cannot be performed (hereinafter referred to as the "non-light-emitting cell" state) in the light-emission sustain process Ic, described later. On the other hand, no discharge, as the aforementioned selective erase discharge, is generated in the display cells to which the aforementioned scanning pulse SP and low-voltage data pulse have been applied. Thus, the display cells that have been in the "light-emitting cell" state until the application of the scanning pulse SP remain in the "light-emitting cell" state. On the other hand, the display cells that have been in the "non-light-emitting cell" state remain in the "non-light-emitting cell" state. That is, each display cell is successively selectively erased by discharge on one display line after another in accordance with display data and set to the "light-emitting cell" state or the "non-light-emitting cell" state.

Subsequently, immediately after the application of the aforementioned scanning pulse SP, the second sustain driver 8 generates repeatedly sustain pulses $IP_Y$ having a positive voltage $V_{SUS}$ as shown in FIG. 19 for each display line and applies the pulses to the row electrodes Y (light-emission sustain process Ic).

Incidentally, the number of times of application of the sustain pulses $IP_Y$ is set in accordance with the weight assigned to each of the subfields SF1 to SF14 and determined in accordance with the brightness mode signal LC supplied from the aforementioned average brightness level detector circuit 311. For example, for the brightness mode signal LC being indicative of "1" as shown in FIG. 9, the sustain pulse $IP_Y$ is applied in the light-emission sustain process Ic of each of the subfields SF1 to SF14 by the following number of times of application. That is, SF1: 1
SF2: 3
SF3: 5
SF4: 8
SF5: 10
SF6: 13
SF7: 16
SF8: 19
SF9: 22
SF10: 25
SF11: 28
SF12: 32
SF13: 35
SF14: 39

On the other hand, for the brightness mode signal LC being indicative of mode 4 as shown in FIG. 9, the sustain pulse $IP_Y$ is applied in the light-emission sustain process Ic of each of the subfields SF1 to SF14 by the following number of times of application. That is, SF1: 4
SF2: 12
SF3: 20
SF4: 32
SF5: 40
SF6: 52
SF7: 64
SF8: 76
SF9: 88
SF10: 100
SF11: 112
SF12: 128
SF13: 140
SF14: 156

In this case, the sustain pulse $IP_Y$ and sustain pulse $IP_X$ are applied alternately to avoid overlapping each other.

According to the aforementioned light-emission sustain process Ic, only the display cells in which wall charges remain or in the "light-emitting cell" state perform the sustain discharge each time the aforementioned sustain pulses $IP_x$, $IP_x$ are applied thereto, sustaining the light-emitting state involved in the sustain discharge by the aforementioned number of times (period).

Then, in the last subfield SF14, in the order in which the sustain pulse $IP_Y$ has been applied for the aforementioned number of times of application, the erasing pulse EP having a negative voltage as shown in FIG. 19 is successively applied to the row electrodes $Y_1$ to $Y_n$ (erase process E).

The application of such an erasing pulse EP causes each display cell to be erased by discharge on one display line after another and thereby all wall charges remaining in each display cell will dissipate.

As described above, the plasma display device shown in FIG. 5 executes the reset process RJ to reset all display cells to the "light-emitting cell" state only in the head subfield SF1. Then, in each of the subfields SF1 to SF14, performed are the data write process Wc for changing selectively each display cell to the "non-light-emitting cell" state and the light-emission sustain process Ic for allowing only the display cells in the "light-emitting cell" state to emit light repeatedly.

According to such a drive method, only the display cells that are sustained to the "light-emitting cell" state in the data write process Wc of each of the subfields repeat light emission involved in the sustain discharge for the number of times assigned to the subfield. At this time, whether a display cell changes to the "non-light-emitting cell" state in the data write process Wc of each of the subfields SF1 to SF14 depends on the logic level of each of the first to fourteenth bit of the cell drive data GD shown in FIG. 17.

That is, with the data bit of the cell drive data GD being at logic level "1", the selective erase discharge is generated in the data write process Wc of the subfield SF (shown in a black circle in FIG. 17) corresponding to the bit digit, thereby causing the display cell to change to the "non-light-emitting cell" state. Incidentally, such a discharge for allowing wall charges to be built in a display cell and thereby the display cell to change to the "light-emitting-cell" state is executed only in the reset process RJ of the head subfield SF1. Thus, once having changed to the "non-light-emitting cell" state by the aforementioned selective erase discharge, the display cell is sustained at the "non-light-emitting cell" state until the aforementioned reset process RJ is executed again.

On the other hand, with the data bit of the cell drive data GD being at a logic level of "0", the aforementioned erase discharge is not generated in the data write process Wc of the subfield SF corresponding to the bit digit. Thus, this causes the display cell to be sustained at the state initialized by the reset process RJ or the "light-emitting-cell" state. Thus, light emission involved in the sustain discharge is continually performed in the light-emission sustain process Ic of the subfields SF (shown in white circle in FIG. 17) that are present until the aforementioned selective erase discharge is generated in one field period.

Then, various halftone levels of brightness are expressed in a stepwise manner based on the sum of the number of times of light emission that is executed in the light-emission sustain process Ic of each of the subfields SF1 to SF14. At this time, according to the drive method that employs the cell drive data GD of 14 bits having 15 bit patterns as shown in FIG. 17, it is made possible to express halftone levels of brightness of 15 types or 15 levels of gray scale, each pattern having the following brightness ratio of light emission. That is, {0, 1, 4, 9, 17, 27, 40, 56, 75, 97, 122, 150, 182, 217, 255}.

Incidentally, the aforementioned display data PD is available for expressing 256 levels of gray scale with 8 bits. In this regard, to implement display of halftone brightness, nearly equal to the 256 levels of gray scale, also by the drive of 16 levels of gray scale as described above, the aforementioned multi-level gray scale processing circuit 33 performs the multi-gray-scale processing such as the error diffusion and dither processing.

Incidentally, according to the drive that employs the cell drive data GD shown in FIG. 17, during the display period in one field, there exist the steady state of light emission (shown in white circles in FIG. 17) in which the display cell is held at the "light-emitting cell" state and the steady state of no light emission in which the display cell is held at the "non-light-emitting cell" state. In addition, during the display period in one field, the display cell changes once or less from the aforementioned steady state of light emission to the steady state of no light emission, and a display cell that has changed to the steady state of no light emission will never restore to the "light-emitting" state. That is, during one field period, no light emission pattern is adapted to invert between the aforementioned steady state of light emission and the steady state of no light emission.

Thus, in one display screen, upon viewing the screen from one region to another, it does not happen to successively view only the steady state of light emission (or steady state of no light emission) in both regions, thus preventing the occurrence of false contours.

Furthermore, according to the present invention, as shown in FIGS. 18 and 19, immediately after data has been written to the display cells on one display line, a sustain discharge is initiated which is responsible for sustaining light emission in the display cells on the display line. That is, after the scanning pulse SP for writing data to each of the display lines has been applied to row electrodes, the application of the sustain pulses IP is initiated to the row electrodes immediately in conjunction with the scanning pulse SP in order to generate the sustain discharge. That is, light emission is sustained in display lines immediately after the completion of writing data.

In the conventional drive method, the sustain light emission is executed simultaneously in all display cells after display data has been written to all display cells on the first to nth display lines. When compared with this conventional drive method, the method according to the present invention can save time spent for the series of aforementioned processes. Thus, it is made possible to increase the levels of gray scale by increasing the number of subfields by making use of the saved time. It is also made possible to improve brightness by increasing the number of times of light emission to be carried out in each light-emission sustain process.

Incidentally, in the aforementioned embodiments, such a case has been described in which what is called the selective erase address method is employed as a method for writing display data. This method allows wall charges to be built in advance in each display cell and then erased selectively in accordance with the display data, thereby writing the display data.

However, the present invention is also applicable to a case in which what is called the selective write address method is employed as a method for writing display data. The selective write address method allows wall charges to be built selectively in each display cell in accordance with the display data.

Figure 20:
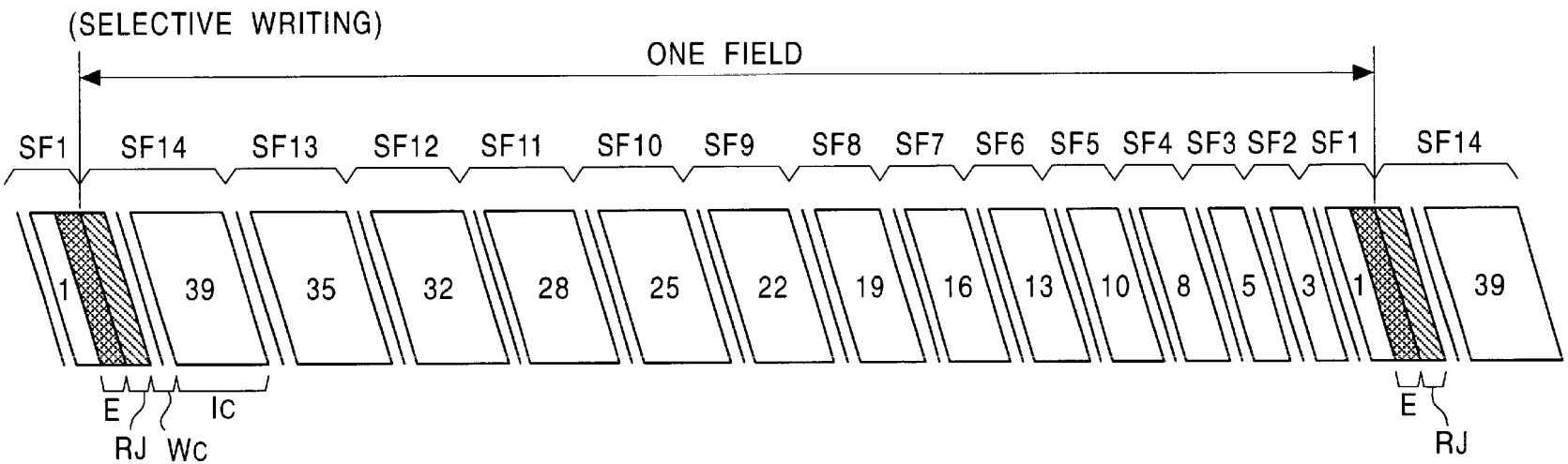
FIG. 20 is a view illustrating the light-emission drive format to be used when the selective erase address method is employed.

FIG. 20 is a view illustrating a light-emission drive format to be used in the drive control circuit 2 when such a selective write address method is employed. In addition, FIG. 21 is a view showing a data conversion table to be used in the second data conversion circuit 34 when the selective write address method is employed, and a light-emission drive pattern based on the cell drive data GD and provided by the data conversion table.

First, in the reset process RJ with the selective write address method being employed, the reset discharge and the erase discharge are continuously generated, thereby causing the wall charges in all display cells to vanish and be thus reset to the "non-light-emitting cell" state. Then, in the data write process Wc with the selective write address method being employed, a discharge (selective write discharge) is generated only in the display cells to which the aforementioned scanning pulse SP and a high-voltage data pulse have been applied simultaneously. At this time, of all display cells, wall charges are built only in the display cells in which the aforementioned selective write discharge has been generated, thus causing the display cells to change to the "light-emitting cell" state. Incidentally, the operation in the light-emission sustain process Ic with the selective write address method being employed is the same as that of the case in which the selective erase address method is employed, and thus not repeatedly explained here.

Accordingly, with the selective write address method being employed, the display cells in which the selective write discharge has been generated in the data write process Wc of the subfields shown by the black circles of FIG. 21 change to the "light-emitting cells" state. Those display cells sustain discharge continuously in each of the subfields shown by the black circles and each of the subfields (shown by the white circles) that are present subsequently to emit light along with the discharge. That is, like the case where the selective erase address method is employed, no light emission pattern is adapted to invert between the steady state of light emission and the steady state of no light emission during one field period, thus preventing the occurrence of false contours.

As described above, according to the drive method of the present invention, a display cell changes from the steady state of light emission to the steady state of no light emission or from the steady state of no light emission to the steady state of light emission once or less during the display period in one field. Furthermore, once having changed to the steady state of no light emission (or the steady state of light emission), a display cell would not restore to the light-emitting state (or the "non-light-emitting" state). Thus, upon viewing the screen from one region to another, it does not happen to successively view only the steady state of light emission (or the steady state of no light emission) in both regions, thus preventing the occurrence of false contours.

In addition, according to the drive method, it is sufficient to perform only once the reset discharge involving a light emission that has nothing to do with the display image during the display period in one field, thereby making it possible to improve the contrast of the display image.

Furthermore, the present invention is adapted to sustain light emission in the display cells on each display line immediately after data has been written to the display cell on one display line after another. The prior-art drive method is adapted to sustain light emission simultaneously in all display cells after display data has been written to all display cells. When compared with the prior-art drive method, the method according to the present invention can save time spent for each process. Thus, it is made possible to increase the levels of gray scale by increasing the number of subfields by making use of the saved time. It is also made possible to improve brightness by increasing the number of times of light emission to be carried out in each light-emission sustain process.

The present application is based on Japanese Patent Application No. 2000-205329 which is hereby incorporated by reference.

What is claimed is:

1. A method for driving a plasma display panel in which a display period of one field of an input video signal is constitued by a plurality of subfields for a gray scale driving, the plasma display panel having a display cell acting as a pixel at each intersection of a plurality of row electrodes acting as a display line and a plurality of column electrodes each intersecting each of said row electrodes, comprising the steps of:

executing a reset process, only in a head subfield during the display period of said one field, for initializing said display cell to a light-emitting cell state, in each of said subfields, executing a data write process for applying successively a scanning pulse for generating a selective erase discharge to each of said row electrodes in order to change selectively each of said display cells from said light-emitting cell state to a non-light-emitting cell state in accordance with said input video signal, and executing a light emission sustain process for applying a train of sustain pulses to each of the row electrodes immediately after said scanning pulse has been applied thereto, the train of sustain pulses generating a sustain discharge to allow only a display cell in said light-emitting cell state to emit light for the number of times corresponding to a weight of each of said subfields.

2. The method for driving a plasma display panel according to claim 1, wherein in said data write process, said scanning pulse is applied to said row electrode immediately after the last sustain pulse in said train of sustain pulses has been applied to said row electrode in said light emission sustain process of a subfield immediately before said subfield.

3. A method for driving a plasma display panel in which a display period of one field of an input video signal is constitued by a plurality of subfields for gray scale drive, the plasma display panel having a display cell acting as a pixel at each intersection of a plurality of row electrodes acting as a display line and a plurality of column electrodes each intersecting each of said row electrodes, comprising the steps of:

executing a reset process, only in a head subfield during the display period of said one field, for initializing said display cell to a non-light-emitting cell state, in each of said subfields, executing a data write process for applying successively a scanning pulse for generating a selective write discharge to each of said row electrodes in order to change selectively each of said display cells from said non-light-emitting cell state to a light-emitting cell state in accordance with said input video signal, and executing a light emission sustain process for applying a train of sustain pulses to each of the row electrodes immediately after said scanning pulse has been applied thereto, the train of sustain pulses generating a sustain discharge to allow only a display cell in said light-emitting cell state to emit light for the number of times corresponding to a weight of each of said subfields.

4. The method for driving a plasma display panel according to claim 3, wherein in said data write process, said scanning pulse is applied to said row electrode immediately after the last sustain pulse in said train of sustain pulses has been applied to said row electrode in said light emission sustain process of a subfield immediately before said subfield.

* * * * *